US007250959B2

(12) United States Patent
Cloutier et al.

(10) Patent No.: US 7,250,959 B2
(45) Date of Patent: Jul. 31, 2007

(54) PRINTER WITH MULTI-PASS MEDIA TRANSPORT

(75) Inventors: Robert P. Cloutier, Spencerport, NY (US); David J. Cornell, Scottsville, NY (US); Michael J. Ehmann, Geneseo, NY (US)

(73) Assignee: Eastman Kodak Company, Rochester, NY (US)

( * ) Notice: Subject to any disclaimer, the term of this patent is extended or adjusted under 35 U.S.C. 154(b) by 204 days.

(21) Appl. No.: 11/176,147

(22) Filed: Jul. 7, 2005

(65) Prior Publication Data

US 2007/0008398 A1 Jan. 11, 2007

(51) Int. Cl.
*B41J 2/38* (2006.01)

(52) U.S. Cl. ..... 347/187

(58) Field of Classification Search ..... 347/187, 347/193, 215, 217, 218, 221, 176, 175; 400/120.04
See application file for complete search history.

(56) References Cited

U.S. PATENT DOCUMENTS 4,794,404 A 12/1988 Shiraishi et al.
5,162,815 A * 11/1992 Hodge ..... 347/217
5,585,835 A 12/1996 Whritenor et al.
5,743,663 A * 4/1998 Imai ..... 400/120.04
5,798,783 A 8/1998 Maslanka et al.
5,838,357 A 11/1998 Maslanka et al.
5,841,460 A * 11/1998 Maslanka et al. ..... 347/176
5,850,246 A 12/1998 Maslanka et al.
6,297,840 B1 * 10/2001 Inana ..... 347/175
2004/0057766 A1 3/2004 Fisher et al.
2004/0189782 A1 * 9/2004 Mogi ..... 347/218
2005/0093959 A1 5/2005 Kitamura

FOREIGN PATENT DOCUMENTS

GB 2 312 650 11/1997

* cited by examiner

*Primary Examiner*—K. Feggins
(74) *Attorney, Agent, or Firm*—Roland R. Schindler, II

(57) ABSTRACT

A thermal printer and method for operating a thermal printer are provided. The thermal printer has a receiver medium path leading past a print nip between a print head and platen. A processor causes an urge roller to move the receiver medium in the forward direction until a trailing edge of the receiver medium is moved to a point where reverse movement of the receiver medium causes the receiver medium to located against a stop surface. The processor then enables the receiver medium to travel in the reverse direction to engage the stop surface wherein the receiver medium path guides the receiver medium along a path of known length from the stop surface to a print line at the print nip.

22 Claims, 25 Drawing Sheets

PRINTER WITH MULTI-PASS MEDIA TRANSPORT

FIELD OF THE INVENTION

This invention relates generally to printers, and, more particularly, to an apparatus to ensure correct loading of a receiver medium in a thermal printer.

BACKGROUND OF THE INVENTION

A wide variety of thermal printers are known to those of ordinary skill in the art. Such thermal printers render images by transferring donor materials in an image wise fashion from a donor web to a receiver medium. Typically, such donor materials are arranged on the donor web in patches of differently colored donor material and a color image is formed on the receiver medium by applying donor material from each of the differently colored donor patches onto the same portion of the receiver medium. Often, a donor web will also provide a patch containing a protective material that is clear and that protects the image from environmental degradation. The protective material must also be applied to the same portion of the receiver medium that bears the image formed by the donor materials. Accordingly, it will be appreciated that color and even monochrome image formation using such printers requires precise alignment of the donor receiver medium relative to a printhead that is used to transfer the donor material to the receiver medium so that donor material from each of the patches and the laminate patch are applied in perfect registration on the receiver medium.

Thus what is needed in thermal printing is a medium transport system that is capable of providing a receiver medium at a particular location relative to a printhead in a fashion that can be repeatedly reproduced at least a minimum number of times for an individual image to be rendered by the printer.

There are a variety of solutions to this problem. In some thermal printers, the recirculation is provided by mounting the receiver medium on a drum such as a vacuum drum from which holds the medium in a precise alignment so that the receiver medium can be moved past a printhead in a repeatable number of cycles. Alternatively, drums are also known that hold a receiver medium using electrostatic forces and/or mechanical clamps. However, the use of such drums increases the size, weight, and cost of the thermal printer.

Other printers such as the highly popular Kodak Easyshare Printer Dock have been developed that use pinch-rollers positioned near a thermal printhead to grip the receiver medium so as to provide control over the movement of the receiver medium such that reciprocal presentation of the receiver medium to the printhead with precise registration is possible. However, such pinch roller type arrangements increase the cost, size, and complexity of the printer and further, in many applications, the use of pinch roller type arrangements requires the use of receiver medium that is oversized longitudinally with respect image recorded thereon. This leaves unprinted marginal areas in an image generated by such printers. These unprinted marginal areas must be removed to provide a satisfactory experience. It will be appreciated that this wastes receiver medium and increases the cost of prints generated by such printer.

Thus what is needed in the art is a new method and apparatus for transporting a receiver medium past a thermal or other imaging head multiple times in a manner that allows donor materials to be applied in a registered manner to the receiver medium from each color patch and/or from a laminate patch in complete registration but without requiring the use of the medium retaining drums, or pinch rollers, or any other medium transport that otherwise requires the use of an oversized medium relative to the image formed thereon.

SUMMARY OF THE INVENTION

In one aspect of the invention, a thermal printer is provided. The thermal printer has a receiver medium path shaped to guide a receiver medium for movement in a forward direction from an urge roller to a print line, the print line being between a printhead and a platen with said platen being adapted to controllably position the receiver medium during printing by the printhead. The receiver medium path is further shaped to guide the receiver medium to return to the urge roller after printing and further has a stop surface positioned to block reverse movement of the receiver medium. A motor is operable to cause the urge roller to urge movement of the receiver medium through the medium transport path in the forward direction.

A processor is operable to cause the urge roller to move the receiver medium through the receiver medium path in the forward direction until a trailing edge of the receiver medium is moved to a point in the receiver medium path where reverse movement of the receiver medium causes the receiver medium to locate against the stop surface, said processor then enabling the receiver medium to travel in the reverse direction to engage the stop surface wherein the receiver medium path guides the receiver medium along a path of known length from the stop surface to the print line. The processor is operable to start printing after the receiver medium is positioned against the stop surface so that the print line is located at a known distance from a trailing edge of the receiver medium when printing is started.

DETAILED DESCRIPTION OF THE INVENTION

Figure 1:
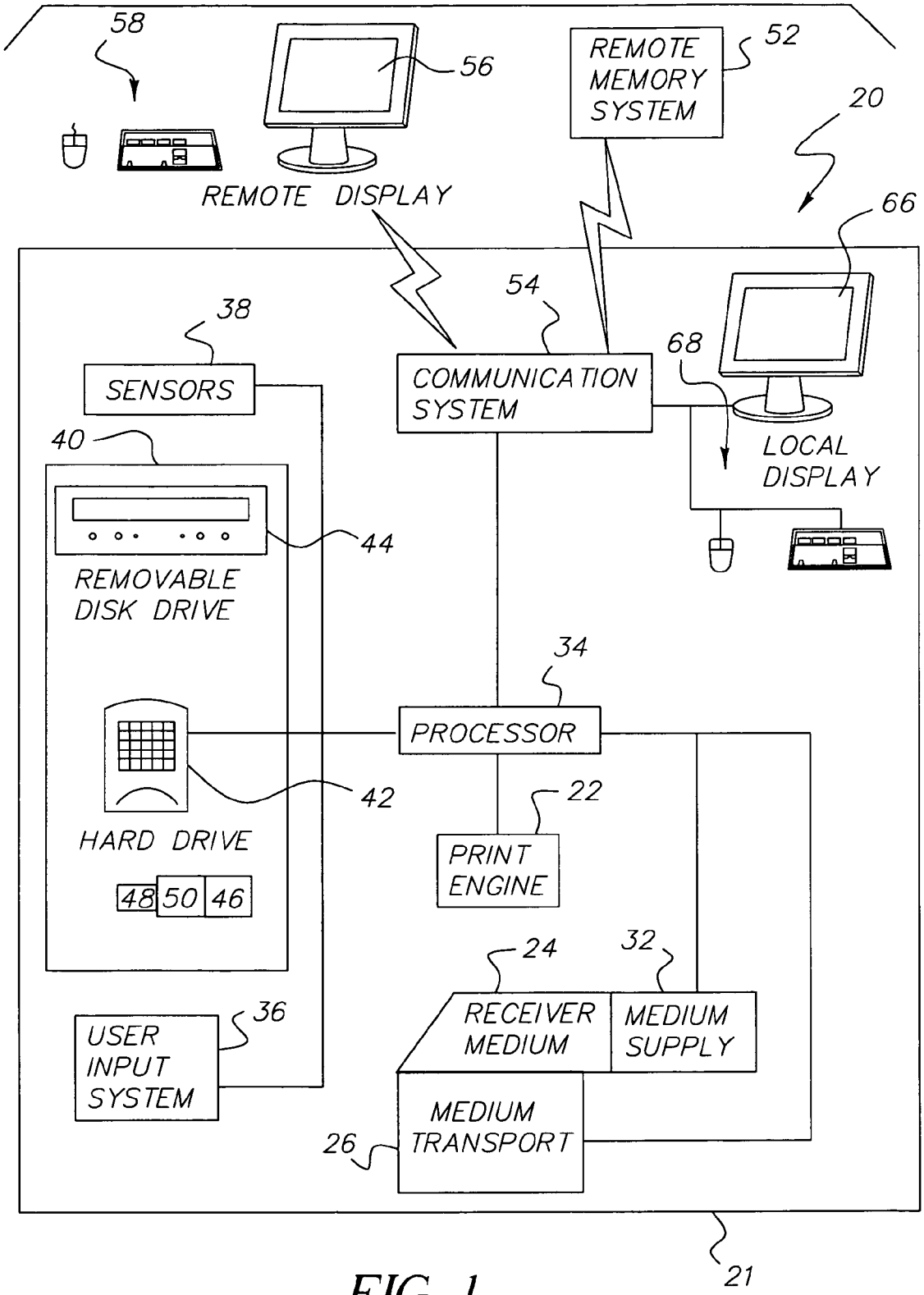
FIG. 1 shows a schematic view of a first embodiment of printer of the invention.

FIG. 1 shows a first embodiment of printer 20 of the invention. As shown in FIG. 1, printer 20 comprises a housing 21 with a print engine 22 that forms an image on a receiver medium 24. In the embodiment of FIG. 1 printer 20 has a print engine 22 of a type that generates color images by causing donor material from more than one differently colored patch of donor material to be thermally transferred from the donor patch in an image-wise pattern onto a receiver medium 24. However, it will be appreciated that methods and apparatuses shown herein can be practiced with a print engine 22 that thermally transfers monotone donor material images such as black and white, grayscale or sepia toned images together with a protective layer that must be applied to such images in registration therewith. However, it will be appreciated that the methods and apparatuses shown herein can also be used with a print engine 22 that can record images on receiver medium 24 using a variety of known technologies including, but not limited to, conventional multi-color separation printing or other contact printing, silk screening, dry electrophotography such as is used in the NexPress 2100 printer sold by Eastman Kodak Company, Rochester, N.Y., USA, drop on demand ink jet technology and continuous inkjet technology.

A medium transport 26 is used to position receiver medium 24 relative to print engine 22 to facilitate recording of an image on receiver medium 24. As will be described in greater detail below, medium transport 26 comprises generally a system for controllably and repeatedly positioning receiver medium 24 relative to print engine 22. Medium transport 26 is also used to load a receiver medium 24 from medium supply 32.

Print engine 22, and medium transport 26 are operated by a processor 34. Processor 34 can include, but is not limited to, a programmable digital computer, a programmable microprocessor, a programmable logic processor, a series of electronic circuits or a series of electronic circuits reduced to the form of an integrated circuit, or a series of discrete components. Processor 34 operates printer 20 based upon input signals from a user input system 36, sensors 38, a memory 40 and a communication system 54.

User input system 36 can comprise any form of transducer or other device capable of receiving an input from a user and converting this input into a form that can be used by processor 34. For example, user input system 36 can comprise a touch screen input, a touch pad input, a 4-way switch, a 6-way switch, an 8-way switch, a stylus system, a trackball system, a joystick system, a voice recognition system, a gesture recognition system or other such systems.

Sensors 38 are optional and can include light sensors and other sensors known in the art that can be used to detect conditions in the environment surrounding printer 20 and to convert this information into a form that can be used by processor 34 in governing operation of print engine 22 and/or printer 20. Sensors 38 can include audio sensors adapted to capture sounds. Sensors 38 also include positioning and other sensors used internally to control printer operations, such as those that are described in greater detail below.

Memory 40 can include conventional memory devices including solid state, magnetic, optical or other data storage devices. Memory 40 can be fixed within printer 20 or it can be removable. In the embodiment of FIG. 1, printer 20 is shown having a hard drive 42, a disk drive 44 for a removable disk such as an optical, magnetic or other disk memory (not shown) and a memory card slot 46 that holds a removable memory 48 such as a removable memory card and has a removable memory interface 50 for communicating with removable memory 48. Data including but not limited to control programs, digital images and metadata can also be stored in a remote memory system 52 that is external to printer 20, such as a personal computer, computer network or other digital system.

In the embodiment shown in FIG. 1, printer 20 has a communication system 54 for communicating using a wired or wireless network to exchange data with a remote memory system 52, a remote display 56, remote input 58. Communication system 54 can be, for example, an optical, radio frequency, other transducer circuit or other system that converts image and other data into a form that can be conveyed to a remote device such as remote memory system 52 or remote display device 56 by way of an optical signal, radio frequency signal or other form of signal. Communication system 54 can also be used to receive a digital image and other information from a host computer or network (not shown). Communication system 54 provides processor 34 with information and instructions from signals received thereby.

A local display 66, and/or local input 68 can also optionally be provided and can communicate with processor 34 directly or by way of user input system 36 and/or by way of communication system 54.

Figure 2:
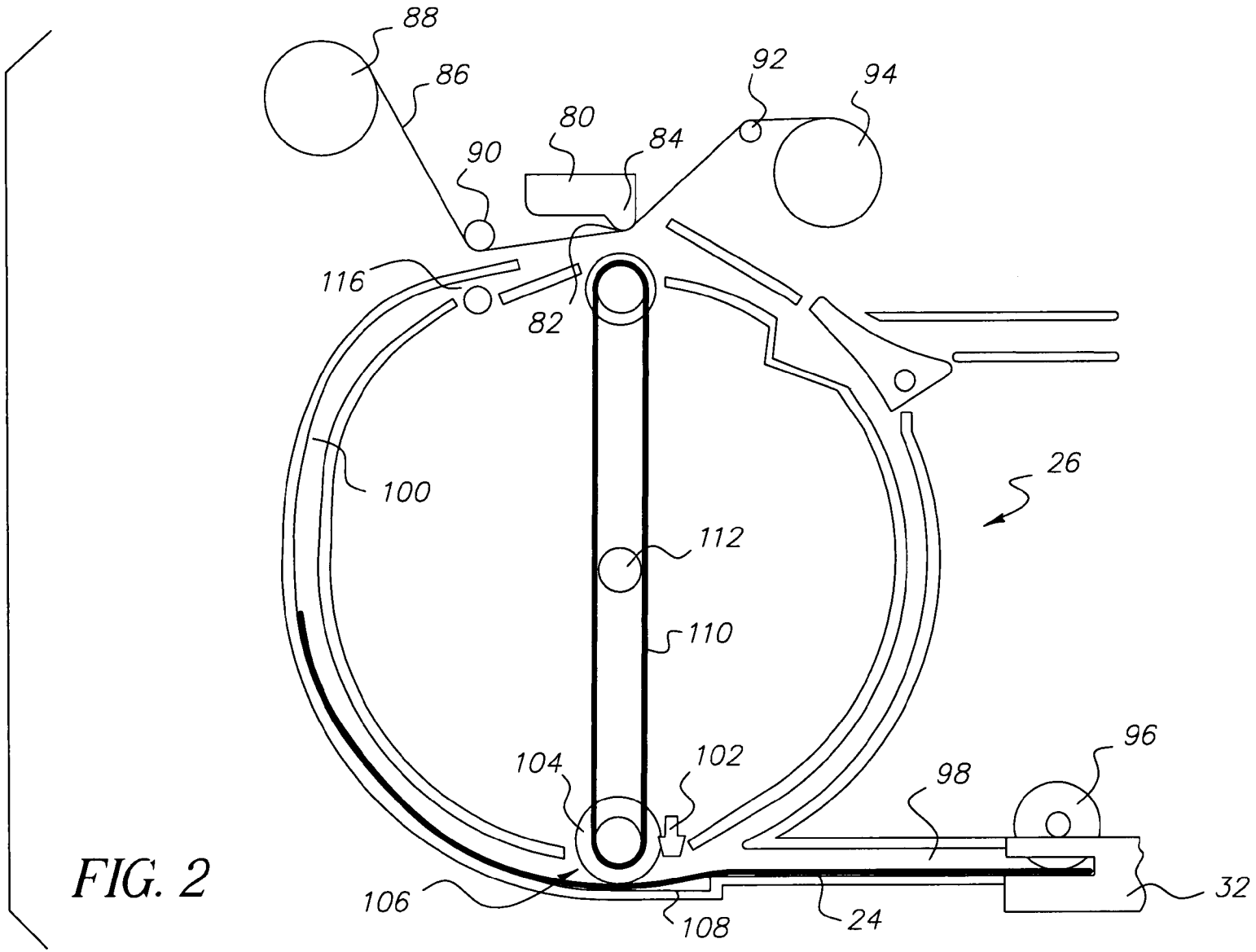
FIG. 2 shows a first embodiment of a medium transport loading a receiver medium.

FIGS. 2–14 show a first embodiment of a medium transport 26 for use with a printer 20 having a print engine with a thermal printhead 80 that applies heat and pressure to transfer donor material from donor web 86 to receiver medium 24. Donor web 86 contains patches of donor material which can comprise, by way of example and not by way of limitation, dyes, colorants, or other materials that can be thermally transferred in an image wise fashion from donor web 86 to receiver medium 24. As shown in FIG. 2, donor web 86 is supplied on a supply spool 88 and passed over a first follower roller 90, past thermal printhead 80, over a second follower roller 92 and collected on donor take-up spool 94. Donor web 86 of FIG. 2 has four different donor materials comprising three differently colored patches of donor material presented in an order arrangement of yellow, magenta, and cyan and a clear overcoat patch being presented on donor web 86 after the color patches. During a printing process, receiver medium 24 must therefore pass thermal printhead 80 four times. It will be appreciated that other types of donor webs with different combinations of donor materials can be used.

The embodiment of medium transport 26 shown in FIGS. 2–12 can be used for loading receiver medium 24 and for staging, printing and recirculating receiver medium 24 so that donor material from each of the donor patches can be recorded to form an image. This process will now be described with respect to FIGS. 2–14.

Medium Loading Process

FIG. 2 shows a medium transport 26 at the onset with a sheet of receiver medium 24 being drawn from medium supply 32 by a motor driven pick roller 96. Pick roller 96 urges receiver medium 24 through a receiver medium supply entrance slot 98.

Receiver medium 24 passes medium sensor 102, and enters an urge nip 106 between urge roller 104 and an outer wall 108 of receiver medium path 100. Medium sensor 102 is adapted to sense when receiver medium 24 is positioned within a sensing zone within receiver medium path 100. Medium sensor 102 can comprise, for example, a reflected light sensor, a contact sensor or any other sensor known to one of ordinary skill in the art that can detect the presence/absence of receiver medium 24

As is illustrated in FIG. 2, during loading urge roller 104 is rotated in a clockwise direction by a belt 110 that is driven by a motor 112. Other known arrangements for driving urge roller 104 can be used, such as providing a motor that directly drives urge roller 104. As receiver medium 24 enters urge nip 106, urge roller 104 is brought into contact with receiver medium 24 and drives receiver medium 24 along receiver medium path 100 to load receiver medium 24 from the medium supply 32 into receiver medium path 100.

Medium Staging Process

Figure 3:
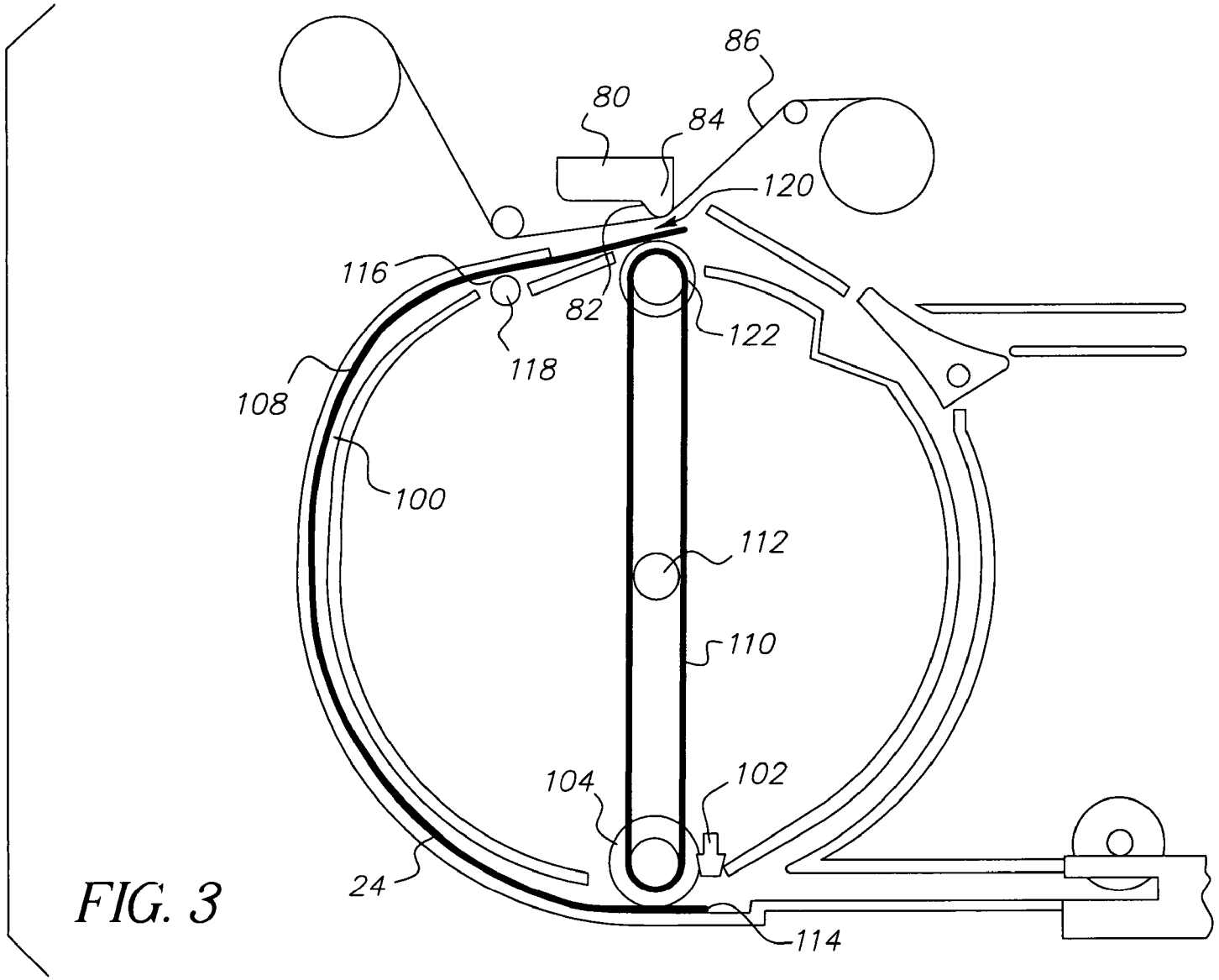
FIG. 3 shows the embodiment of FIG. 2 during a staging process with a receiver medium after having been urged along receiver medium path to a point where a trailing edge of receiver medium passes a medium sensor.

Once receiver medium 24 has been loaded, receiver medium 24 is then staged for use in printing. Turning now to FIG. 3, what is shown is a receiver medium 24 after having been urged along receiver medium path 100 to a point where a trailing edge 114 of receiver medium 24 passes medium sensor 102 so that medium sensor 102 no longer detects the presence of receiver medium 24. When this occurs, processor 34 receives a signal from medium sensor 102 indicating that receiver medium 24 is no longer present. Processor 34 then transmits signals causing motor 112 to cease driving belt 110 which, in turn, suspends the rotation of urge roller 104 and the further movement of receiver medium 24 along receiver medium path 100. As is illustrated in FIG. 3, as receiver medium 24 is advanced along receiver medium path 100, receiver medium 24 passes through a space gate 116 shown as a space between a guide member 118 and outer wall 108 of receiver medium path 100. Space gate 116 defines a path that helps to guide receiver medium 24 in a direction that leads to a printing nip 120 between a line or array of printing elements 82 extending across an image receiving area of receiver medium 24 to define a print line 84 at thermal printhead 80. In the embodiment illustrated, printing elements 82 are shown in cross-section.

In FIG. 3, thermal printhead 80 is shown to be positioned by an actuator (not shown) in a raised position that is not used for printing, but allows for free movement of receiver medium 24 and/or donor web 86 through printing nip 120. Platen 122 is shown connected to motor 112 by way of belt 110 and accordingly, platen 122 rotates in concert with urge roller 104 to facilitate movement of receiver medium 24. In other embodiments, platen 122 can be allowed to freely rotate during movement of receiver medium 24 by urge roller 104. In still other embodiments urge roller 104 can be provided with means for moving platen 122 to a position where platen 122 is unlikely the contact receiver medium 24.

Such clockwise movement of receiver medium 24 is continued until trailing edge 114 of receiver medium 24 passes medium sensor 102. At this point receiver medium 24 is substantially in contact with outer wall 108 of receiver medium path 100. When this occurs, medium sensor 102 sends a signal to processor 34 causing processor 34 to reverse motor 112 so that urge roller 104 will drive receiver medium 24 in a counter clockwise direction along a receiver medium path 100.

Figure 4:
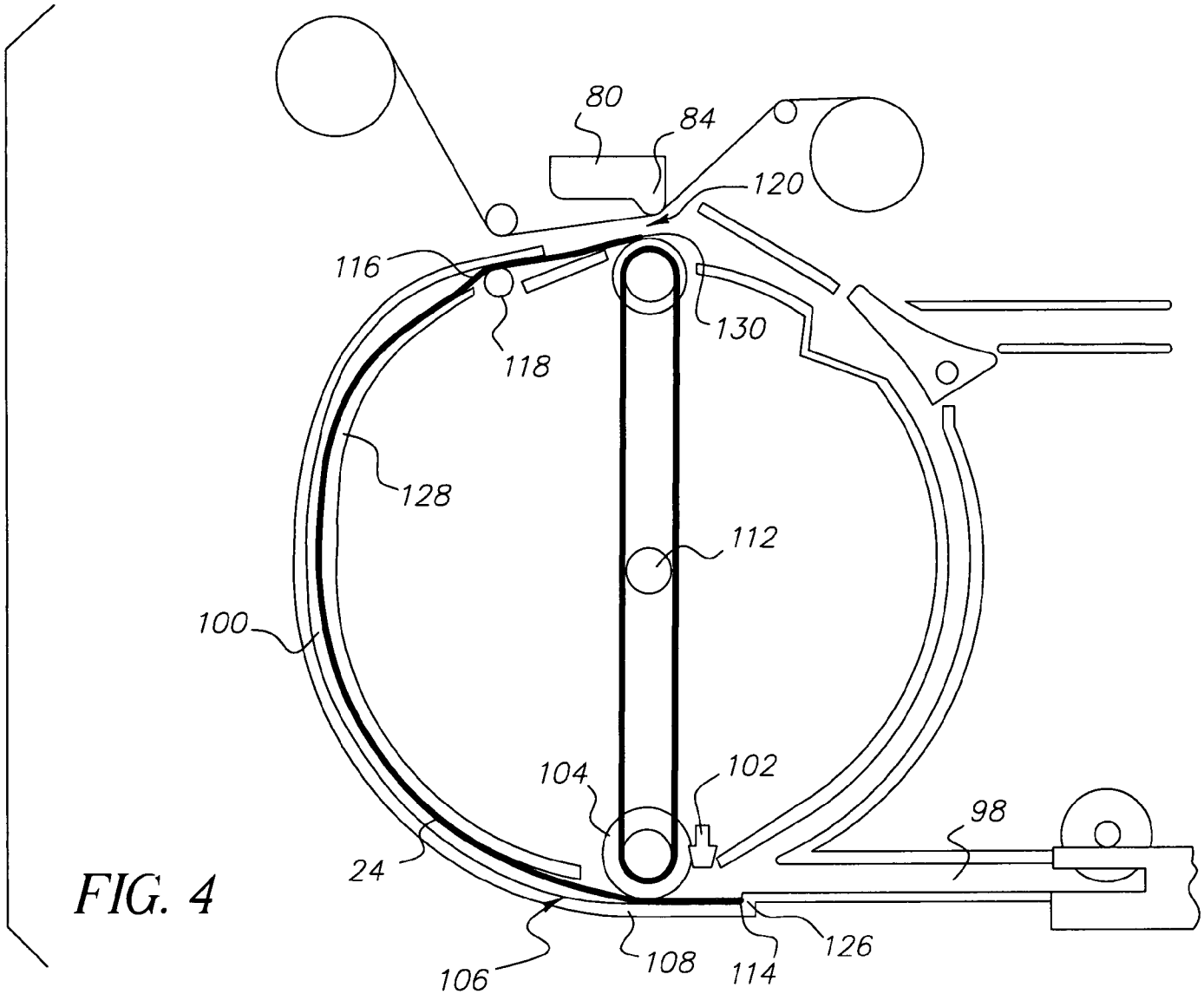
FIG. 4 shows the embodiment of FIG. 2 during the staging process with a trailing edge of receiver medium urged into contact with a stop surface.

As is shown in FIG. 4, during counter-clockwise movement, receiver medium 24 is bent and resiliently expands against the bending so that trailing edge 114 generally follows outer wall 108. Accordingly, as receiver medium 24 is moved in a counter clockwise direction, trailing edge 114 of receiver medium 24 is urged along outer wall 108 into contact with a stop surface 126. Stop surface 126 prevents further counterclockwise movement of receiver medium 24 and further prevents receiver medium 24 from reentering medium supply entrance slot 98. Processor 34 is adapted to operate motor 112 so as to drive urge roller 104 for a time sufficient to ensure that at the conclusion of the urging, receiver medium 24 has been urged against stop surface 126. In one embodiment of the invention, processor 34 can determine the amount of time required to urge receiver medium 24 against stop surface 126 by detecting when trailing edge 114 of receiver medium 24 passes medium sensor 102 and determining from this the amount of additional time necessary to assure proper positioning of receiver medium 24 based upon this.

As shown in FIG. 4, when receiver medium 24 is urged the counterclockwise direction through receiver medium path 100, receiver medium 24 is drawn against an inner wall 128 of receiver medium path 100 by a force applied to receiver medium 24 so that when receiver medium 24 is properly positioned against stop surface 126 receiver medium 24 follows a path of a known distance beginning at stop surface 126 and extending to printing nip 120. In the embodiment illustrated in FIG. 4, a tension is created between a load applied to receiver medium 24 by outer wall 108 and guide member 118 at space gate 116 and the urging force applied by urge roller 104 at urge nip 106 which tends to draw receiver medium 24 against inner wall 128 so as to define a generally fixed path at which receiver medium 24 must follow between stop surface 126 and print line 84.

This provides accurate and repeatable arrangement for positioning leading edge 130 of receiver medium 24 at printing nip 120 so that printing can begin at leading edge 130. It will be appreciated that using this method of positioning will reduce the variability of the location of the leading edge 130 of receiver medium 24 to the variability in the length of receiver medium 24 which is typically well regulated.

Accordingly, repeatable placement of the leading edge 130 or other start of print point of an individual receiver medium 24 relative to a print line 84 for each pass of a receiver medium 24 in a multi-pass printing system is possible in a simple, low cost, and highly repeatable manner.

Figure 5:
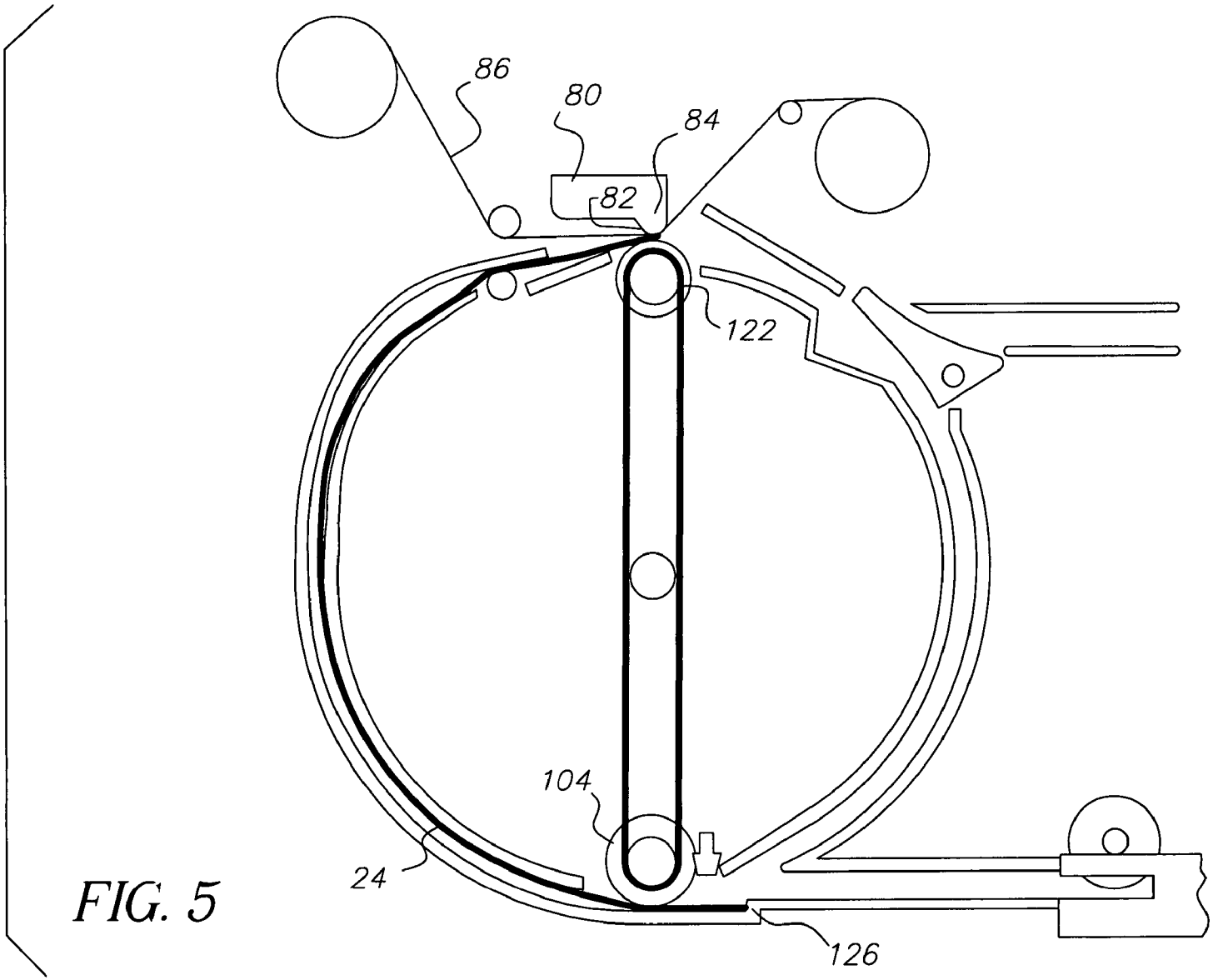
FIG. 5 shows the embodiment of FIG. 2 during the staging process with a trailing edge of receiver medium urged into contact with a stop surface and with a thermal printhead in a closed position.
Figure 6:
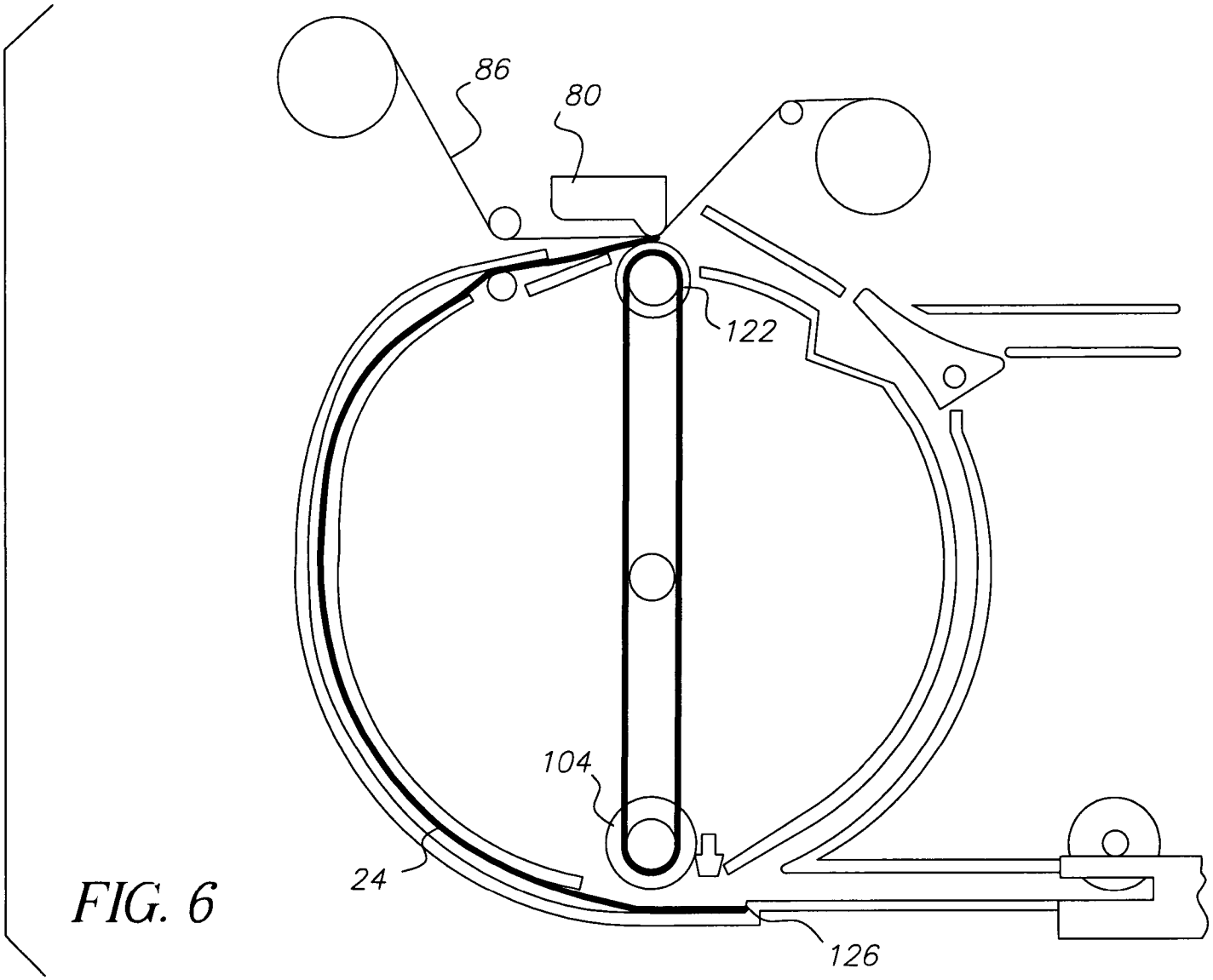
FIG. 6 shows the embodiment of FIG. 2 at the start of the printing process with a trailing edge of receiver medium urged into contact with a stop surface and with a thermal printhead in a closed position and with urge roller optionally moved out of contact with the receiver medium.

FIGS. 5 and 6 show, respectively, the process of transferring control of movement of the receiver medium 24 from urge roller 104 to platen 122 in preparation for the initiation of printing operations. As shown in FIG. 5, after receiver medium 24 has been positioned against stop surface 126, processor 34 causes thermal printhead 80 to close and thereby apply pressure between printing elements 82, donor web 86, receiver medium 24, and platen 122 in anticipation of printing operations. As shown in FIG. 6, an optional step of moving urge roller 104 out of contact with receiver medium 24 is performed so as to prevent any unintentional consequences caused by contact between urge roller 104 and receiver medium 24 during printing. Any actuator (not shown) known to one of skill in the art can be used for this purpose.

Printing

Figure 7:
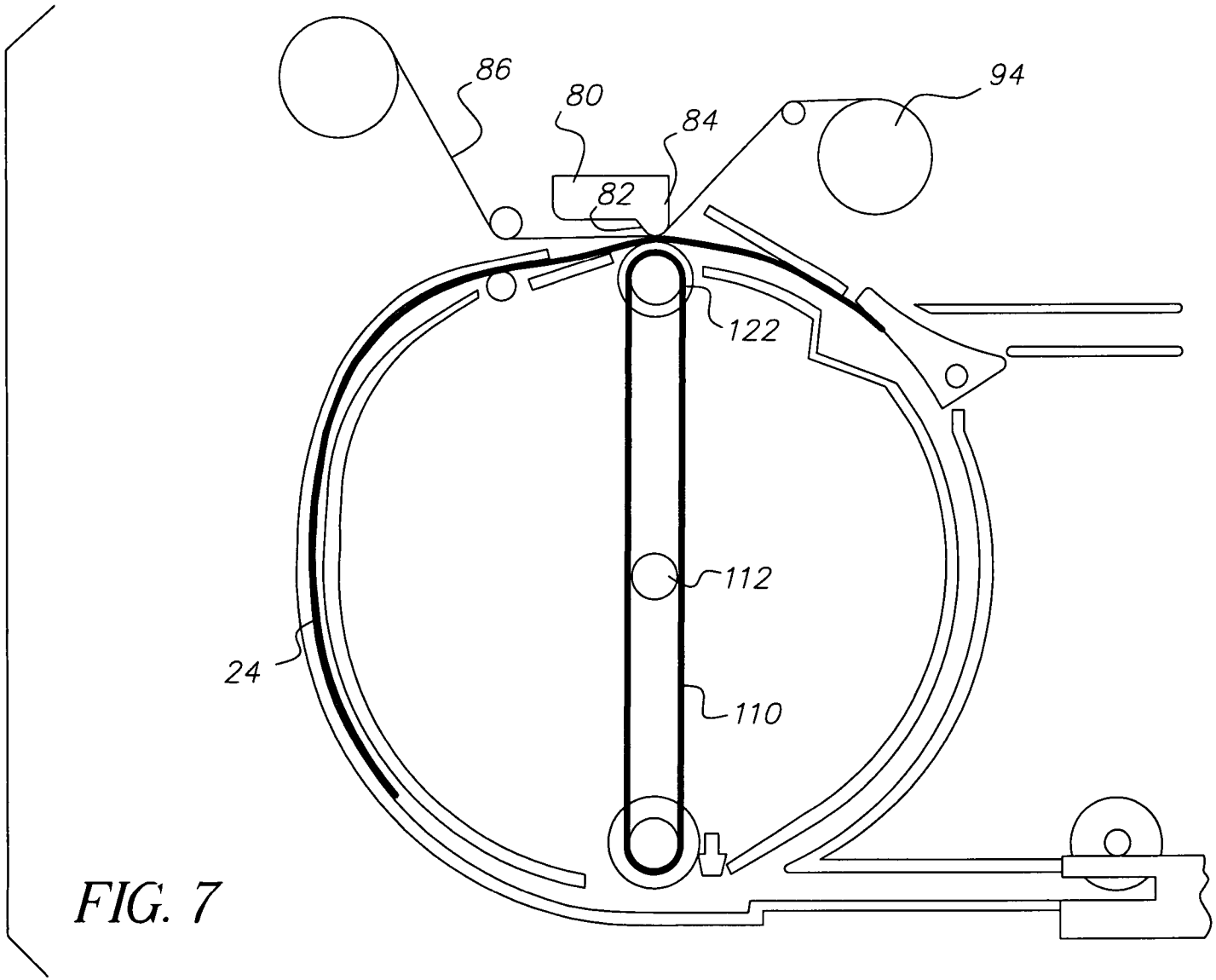
FIG. 7 shows the embodiment of FIG. 2 during the printing process.

As is illustrated in FIG. 7, processor 34 begins a printing operation by concurrently transmitting instructions to thermal printhead 80 and to motor 112. The signals sent to thermal printhead 80 cause printing elements 82 to selectively heat so as to cause a line of donor material from donor web 86 to be transferred onto receiver medium 24. The signals transmitted to motor 112 cause motor 112 to rotate belt 110, rotating platen 122 in a clockwise fashion so as to advance receiver medium 24 relative to thermal printhead 80 so that multiple lines of donor materials can be applied to receiver medium 24 in an imagewise pattern.

In the embodiment illustrated, contact between receiver medium 24 and donor web 86 causes donor web 86 to be drawn past printing elements 82 as receiver medium 24 is driven by platen 122. In other embodiments, donor take-up spool 94 can be driven by an actuator (not shown) to create a tension in donor web 86 to draw donor web 86 past print line 84 in concert with receiver medium 24.

Figure 8:
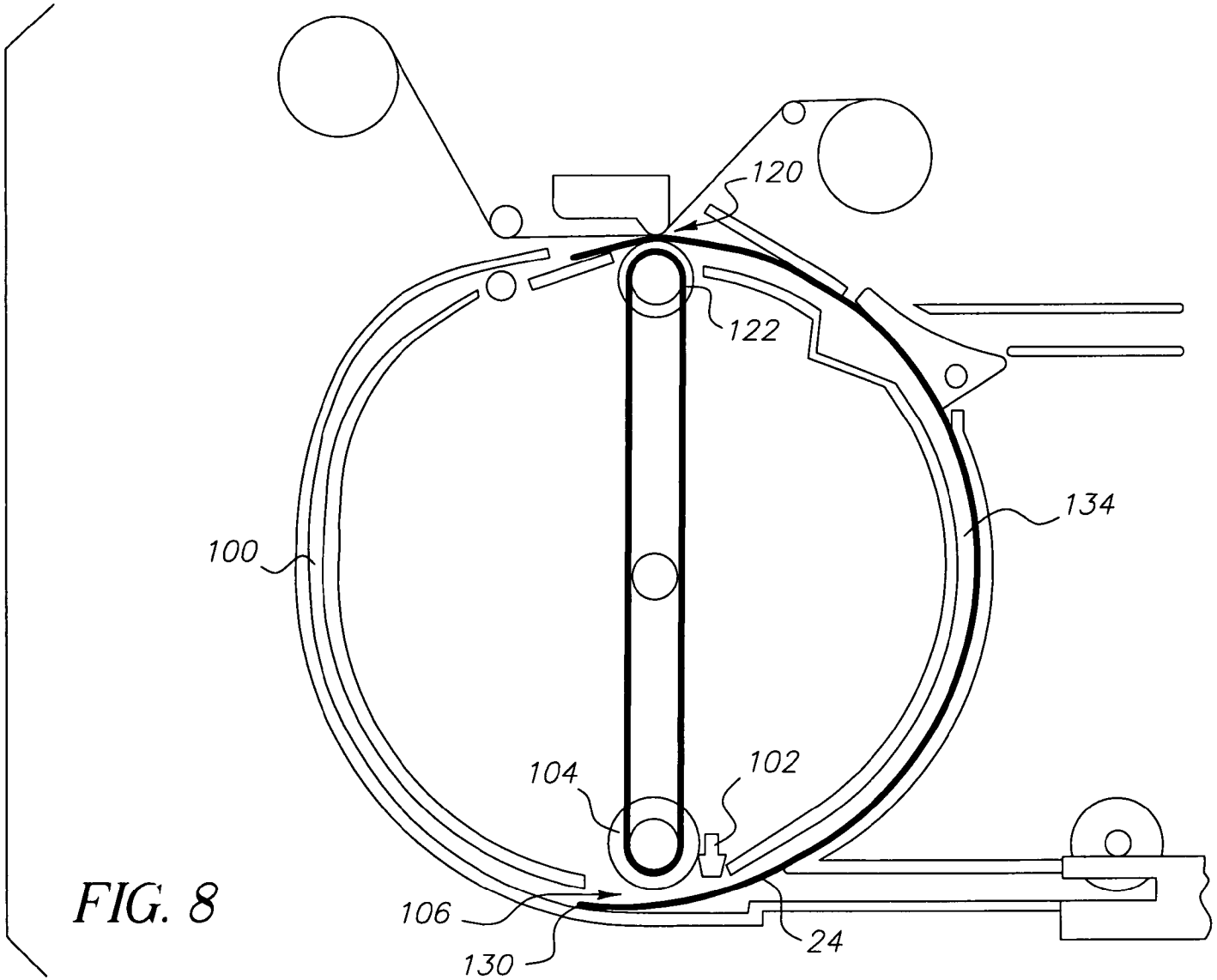
FIG. 8 shows the embodiment of FIG. 2 during printing.

As is shown in FIG. 8, receiver medium path 100 defines a return path 134 from printing nip 120 to urge nip 106 that has a distance that is less than a length of receiver medium 24 so that leading edge 130 of receiver medium 24 is advanced past medium sensor 102 and urge nip 106 while receiver medium 24 is being moved in the clockwise direction by platen 122. In this way, receiver medium 24 is never positioned at any point in receiver medium path 100 wherein at least one of the urge roller 104 or platen 122 is not capable of urging, moving, or otherwise controlling the position of receiver medium 24.

Figure 9:
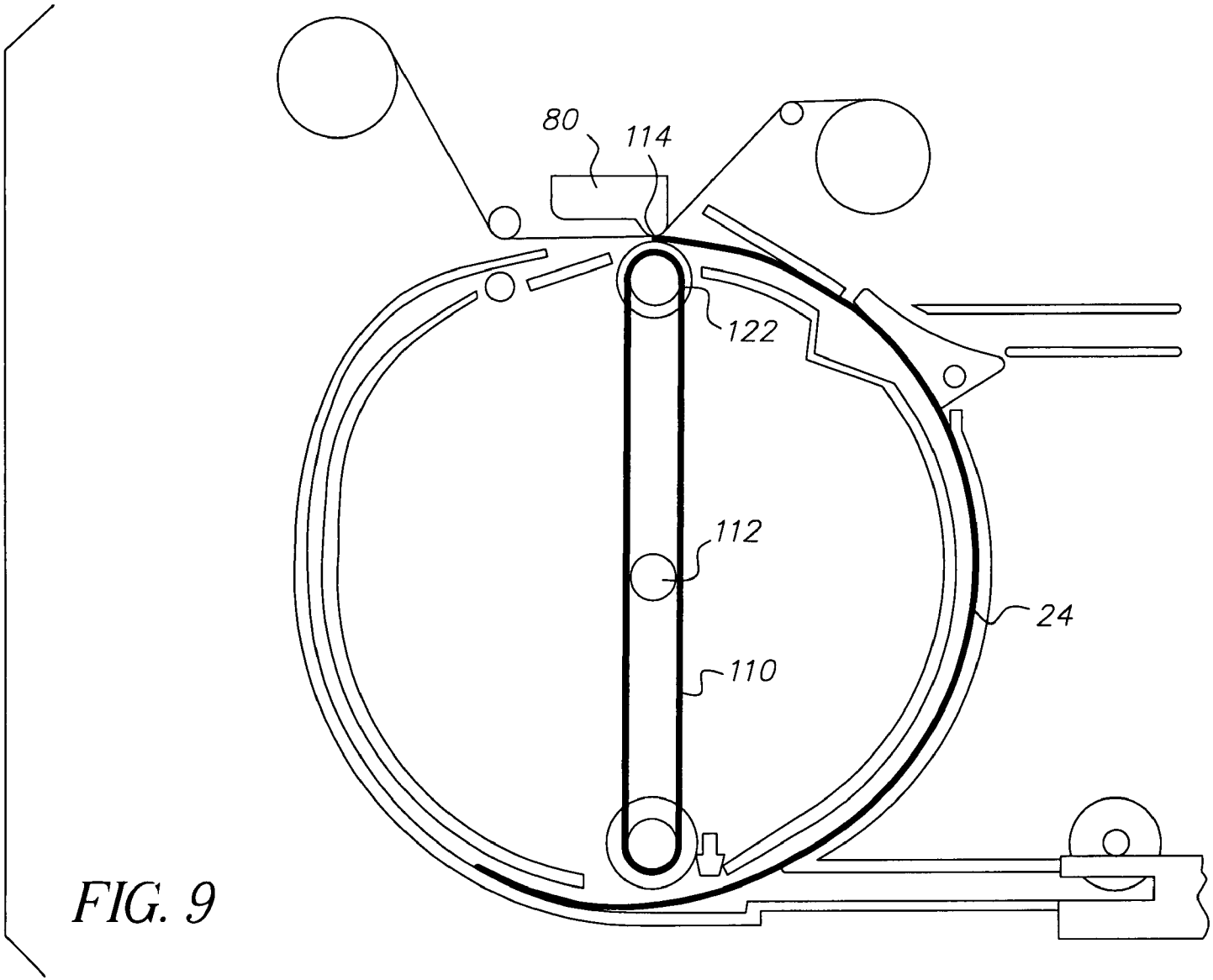
FIG. 9 shows the embodiment of FIG. 2 at the conclusion of the printing process.

As is shown in FIG. 9, at the conclusion of the first printing process, which can be when trailing edge 114 of receiver medium 24 reaches print line 84, processor 34 causes motor 112 to stop rotating belt 110 which in turn stops platen 122 from moving receiver medium 24.

Receiver Medium Recirculation

Figure 10:
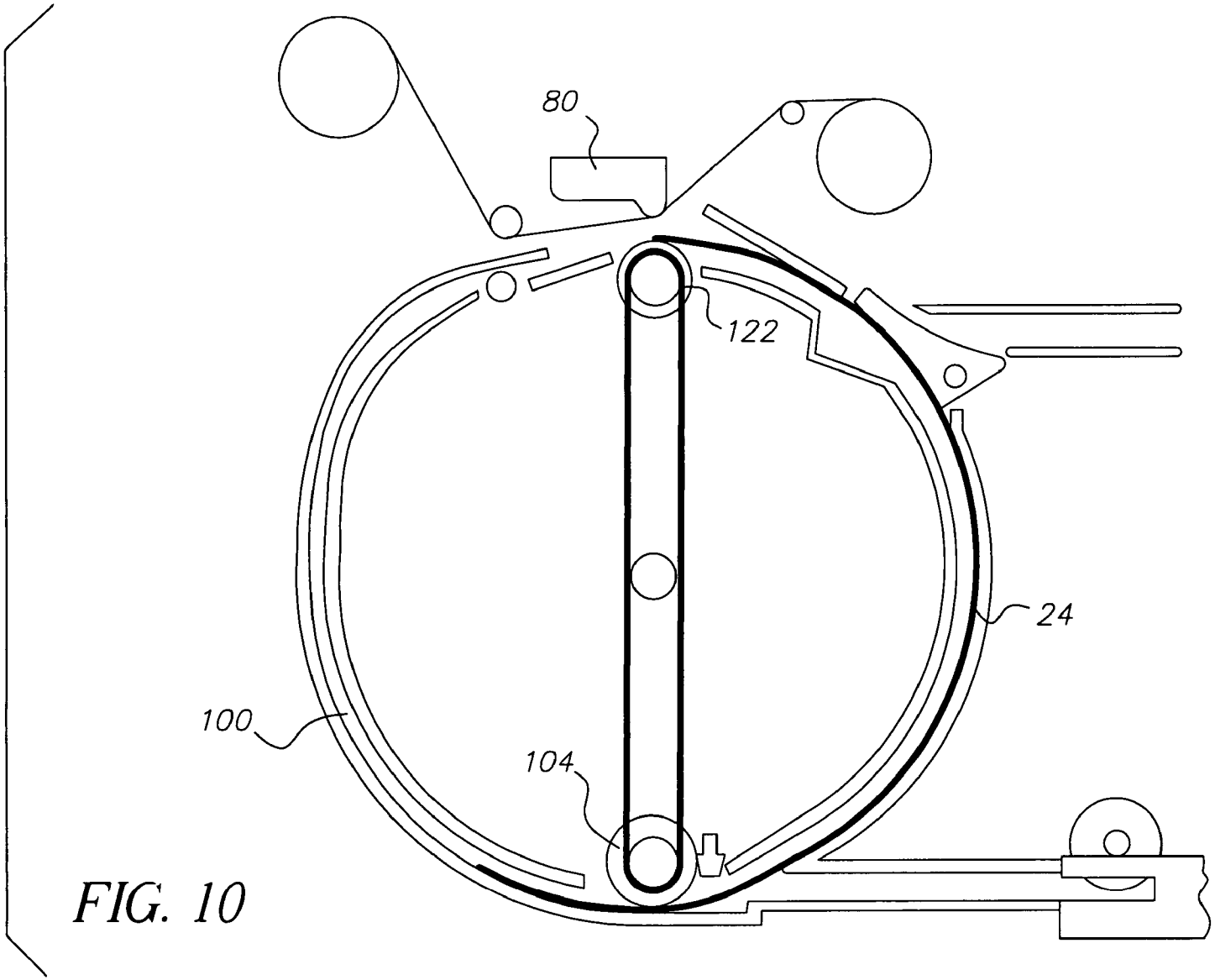
FIG. 10 shows the embodiment of FIG. 2 at the start of the recirculation process.

FIG. 10 illustrates, the process for staging receiver medium 24 after a printing step. After printing, processor 34 generates signals causing thermal printhead 80 to move away from platen 122 and executes a recirculation process by first generating signals causing urge roller 104 to move into contact with receiver medium 24 (if urge roller 104 is not already in such contact) and causing urge roller 104 to drive receiver medium 24 along receiver medium path 100 in preparation for subsequent staging and printing operations. This replicates the effect achieved by the operations shown and described in FIG. 5.

Figure 11:
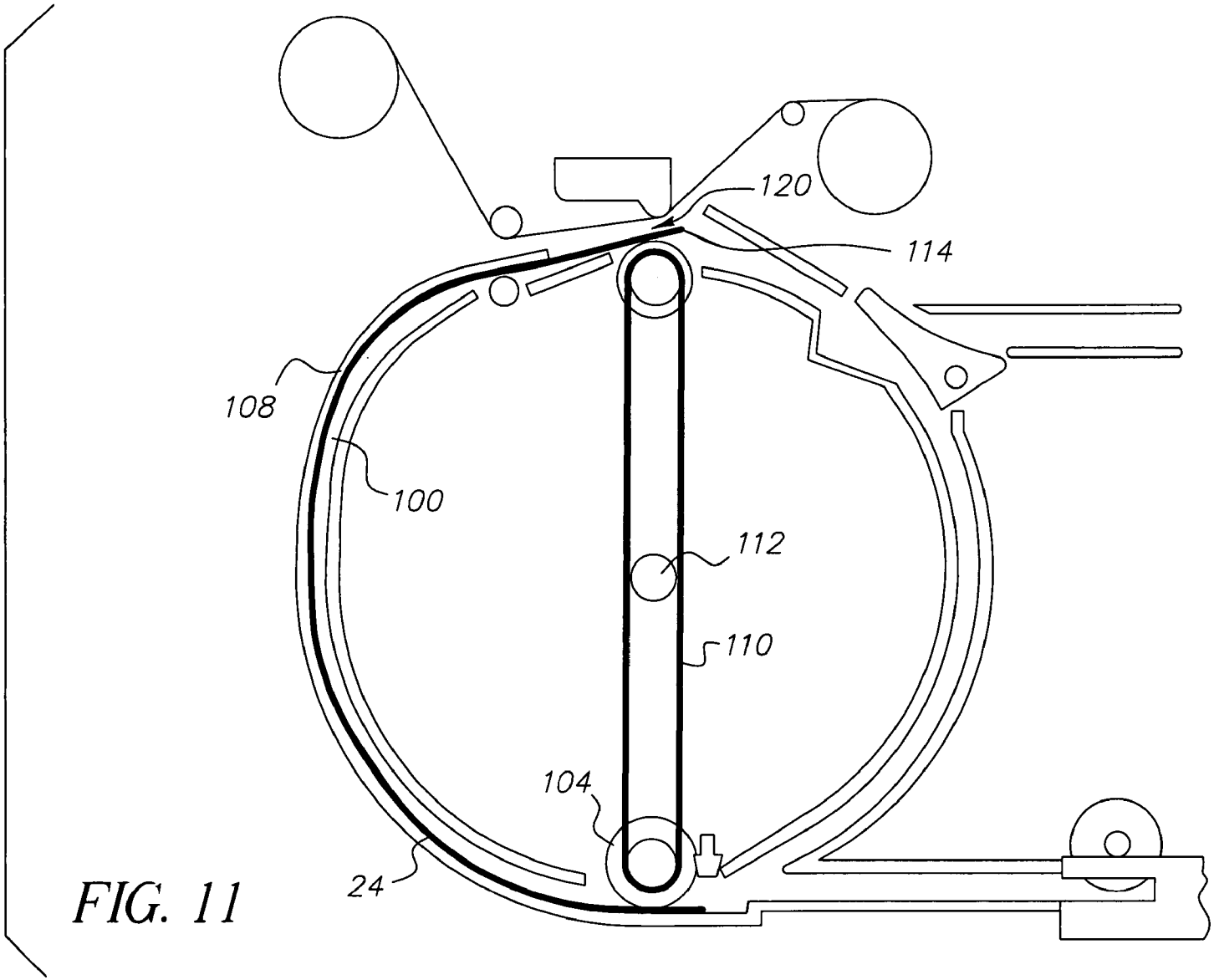
FIG. 11 shows the embodiment of FIG. 2 at a further point in the recirculation process.

As shown in FIG. 11, during recirculation, processor 34 sends signals to motor 112 causing urge roller 104 to be rotated in a clockwise direction by belt 110 and drives receiver medium 24 further along outer wall 108 of receiver medium path 100 to a position where leading edge 130 of receiver medium 24 is positioned past the printing nip 120.

It will be appreciated that registration of the first image and second image is critical for optimal image quality. Accordingly, it is necessary to ensure that receiver medium 24 is positioned at the start of each subsequent printing operation in the same position that receiver medium 24 was positioned at the start of the first printing operation.

To accomplish this, processor 34 is adapted to execute the recirculation process so that staging process described above with respect to FIGS. 3, 4, and 5 can be executed on the recirculated receiver medium 24.

Subsequent Staging, Printing and Recirculation Operations

When the recirculation process concludes, receiver medium 24 is properly positioned for executing a staging process as described above with reference to FIGS. 2–5 and a printing process with respect to FIGS. 6, 7, 8 and 9. At some point prior to executing the printing process, processor 34 will actuate donor take-up spool 94 and optionally, donor supply spool 88 using actuators (not shown) to advance a subsequent donor patch so that printhead 80 can use the next donor patch for recording an image onto previously recorded images using the processes described generally above with respect to FIGS. 6, 7, 8 and 9. After subsequent printing operations, processor 34 will cause a recirculation process to be executed until a final printing operation is executed.

Final Printing Operation

Figure 12:
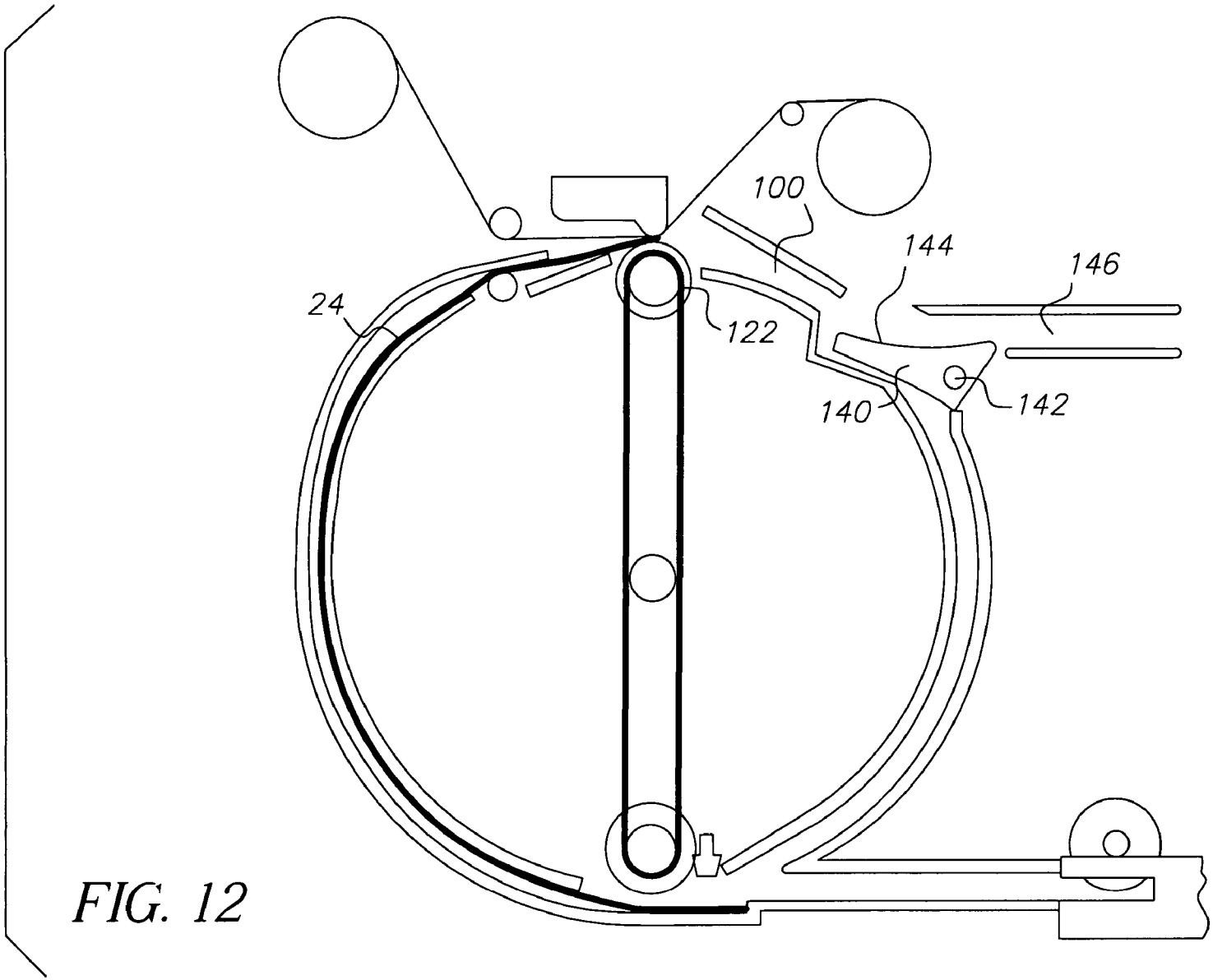
FIGS. 12–14 show the embodiment of FIG. 2 at a final printing process.
Figure 13:
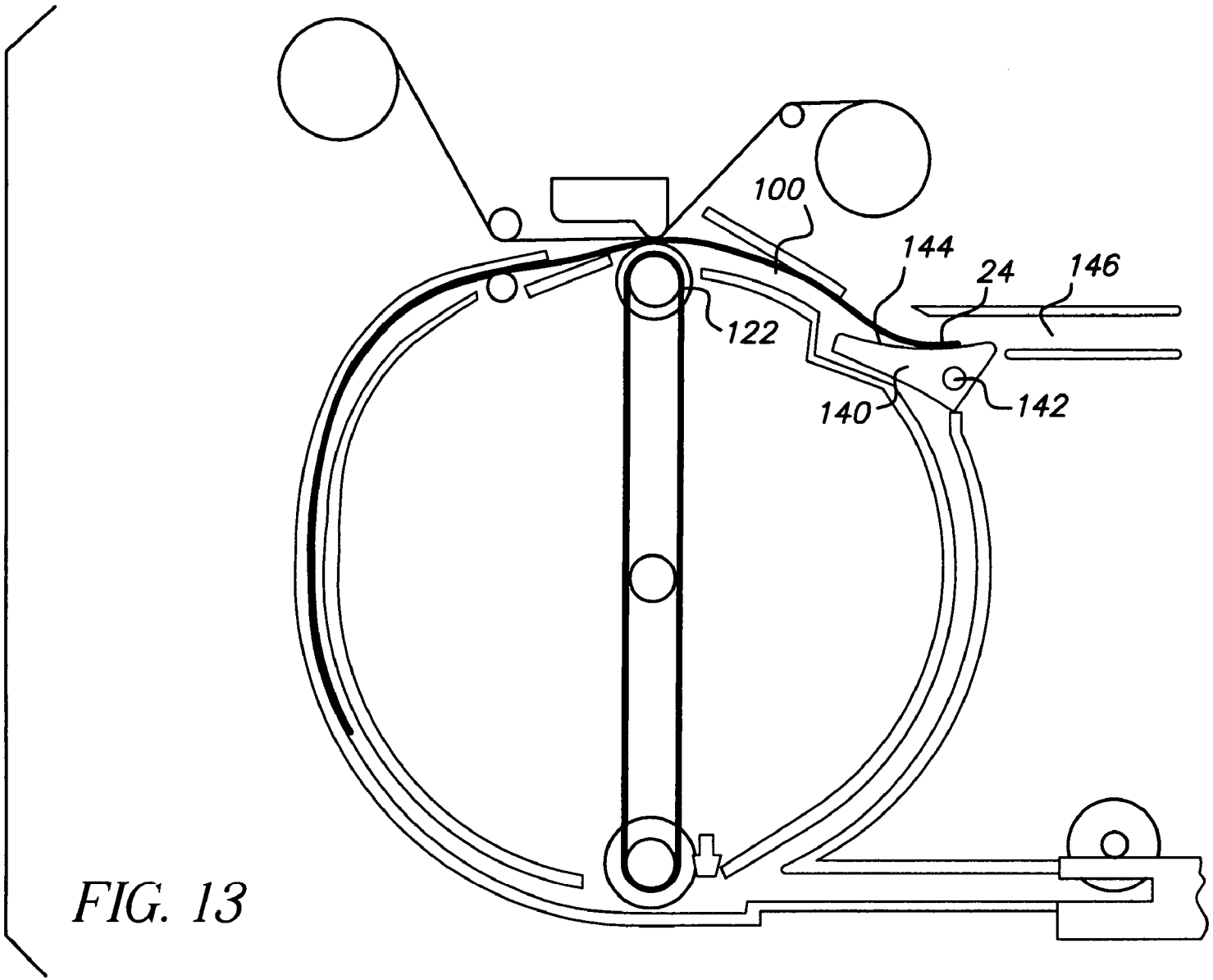
Figure 14:
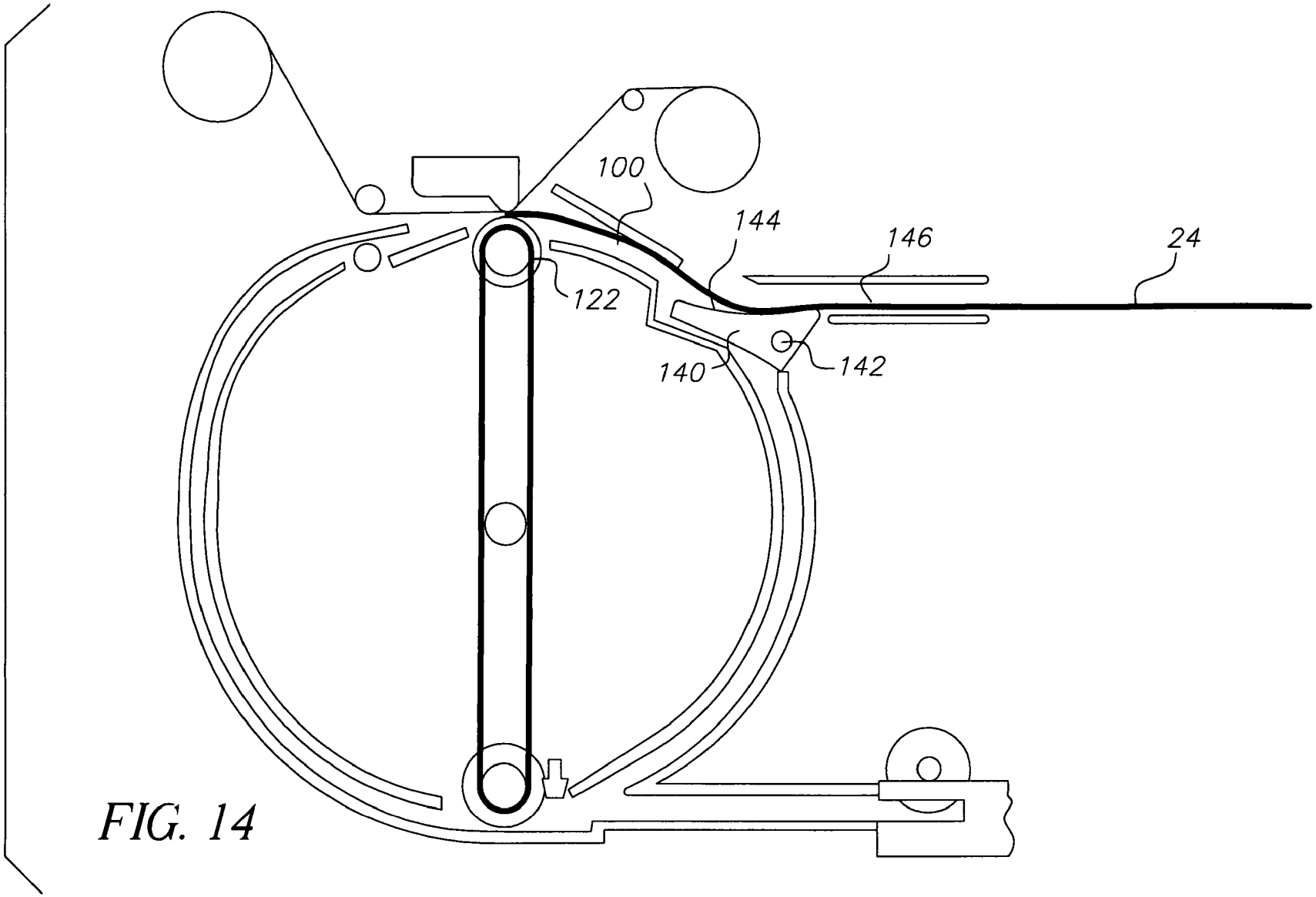

FIGS. 12, 13 and 14 illustrate a final printing operation, which in this embodiment comprises the application of an optional clear overcoat which can be applied in a uniform or imagewise fashion. In FIGS. 12, 13, and 14, printing is executed as is generally described above with respect to FIGS. 6, 7, 8 and 9 described above. However, as shown in FIGS. 12, 13, and 14, a diverter 140 is positioned by an actuator 142 so that diverter 140 interposes a deflection surface 144 into receiver medium path 100 to deflect receiver medium 24 as receiver medium 24 is moved by platen 122 so that the receiver medium travels along an exit path 146 which can lead to an exit of the printer or to some other destination for a printed image.

Alternate Embodiment of Medium Transport Path

Figure 15:
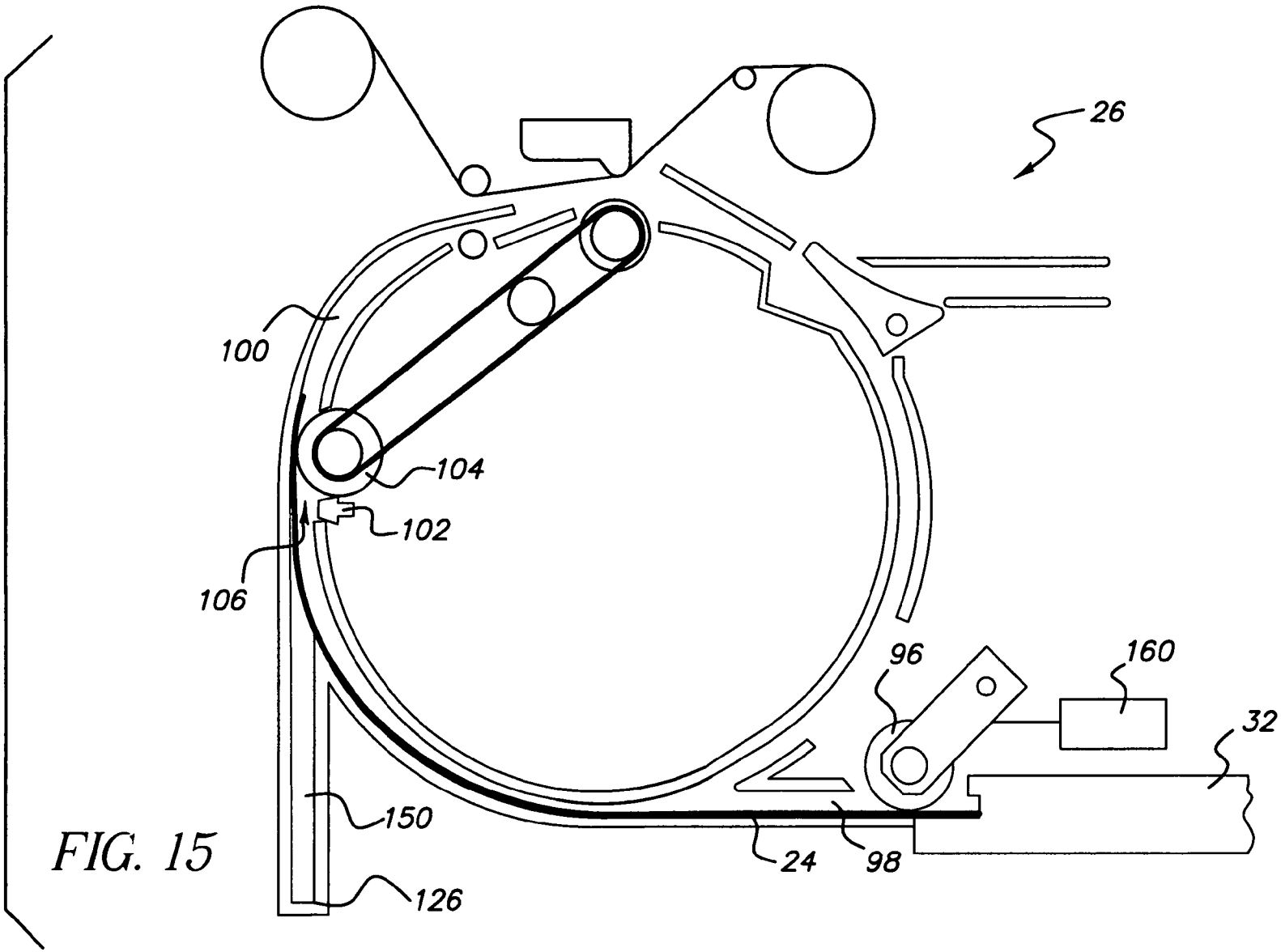
FIGS. 15–19 show another embodiment of the receiver medium path of a printer of the invention.

FIGS. 15–19 illustrate another embodiment of a medium transport 26 of the invention in which a stop surface 126 is provided in a medium staging path 150 that is generally separate from the receiver medium path 100. In FIG. 15, medium transport 26 is shown at the onset of a medium loading process with a sheet of receiver medium 24 being drawn from medium supply 32 by a motor driven pick roller 96 that is positioned in a loading position by an actuator 160. Pick roller 96 urges receiver medium 24 through receiver medium supply entrance slot 98 so that receiver medium 24 passes a receiver medium sensor 102 and enters an urge nip 106 as described above. As receiver medium 24 enters urge nip 106, receiver medium 24 is brought into contact with urge roller 104, and urge roller 104 drives receiver medium 24 along receiver medium path 100 to load receiver medium 24.

Figure 16:
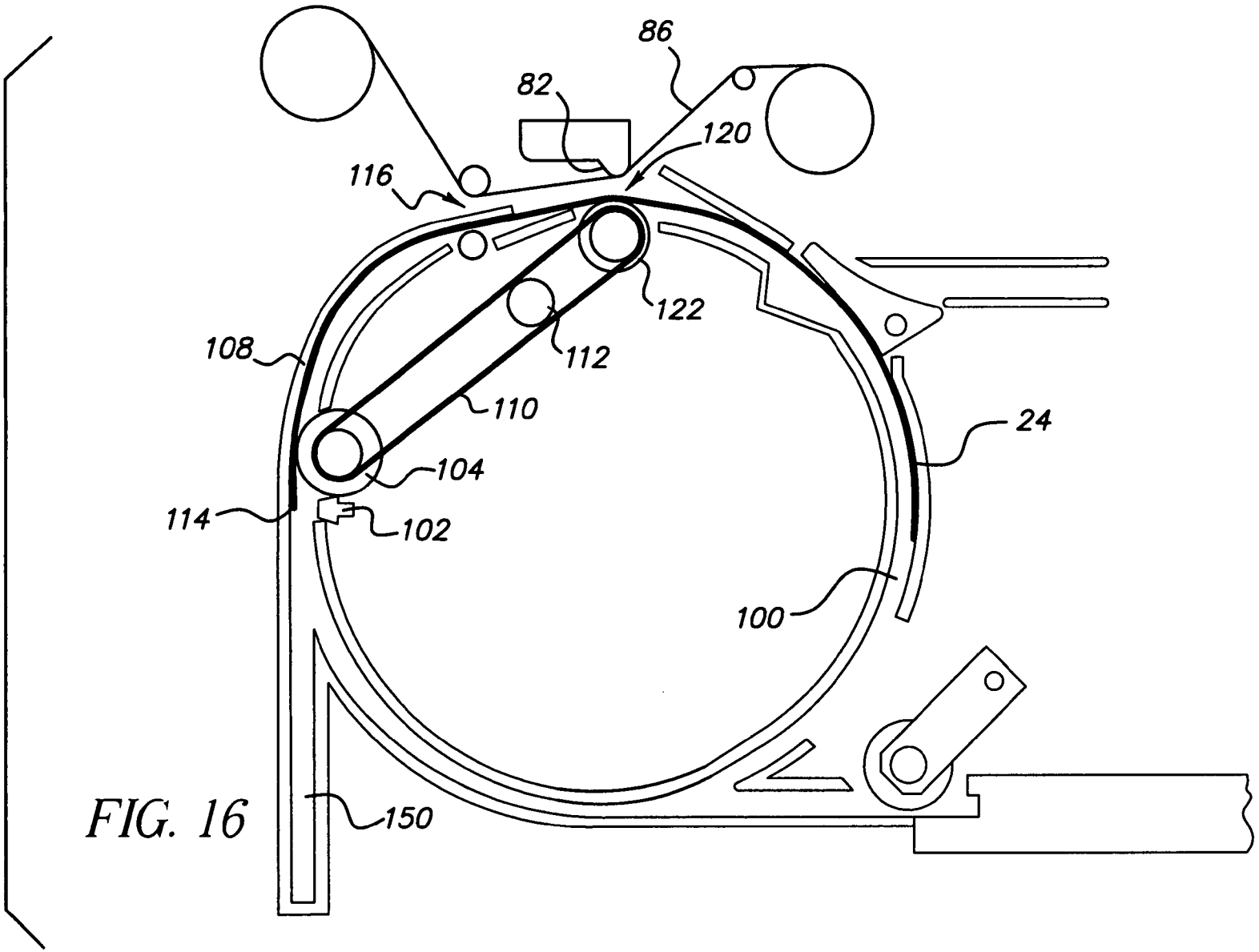

As illustrated in FIG. 16, receiver medium 24 is urged by urge roller 104 along receiver medium path 100 to a position where a trailing edge 114 of receiver medium 24 passes medium sensor 102 so that medium sensor 102 no longer detects the presence of receiver medium 24. When this occurs, processor 34 receives a signal from medium sensor 102 indicating that receiver medium 24 is no longer present. Processor 34 then transmits signals causing motor 112 to cease driving belt 110 which, in turn, suspends the rotation of urge roller, the and the further movement of receiver medium 24 along receiver medium path 100. As illustrated in FIG. 16, as receiver medium 24 is advanced along receiver medium path 100, receiver medium 24 passes through space gate 116 shown as a space between guide member 118 and outer wall 108 of receiver medium path 100. Space gate 116 defines a path that helps to guide receiver medium 24 in a direction that leads to a printing nip 120 between printing elements 82, donor web 86, and a platen 122.

Figure 17:
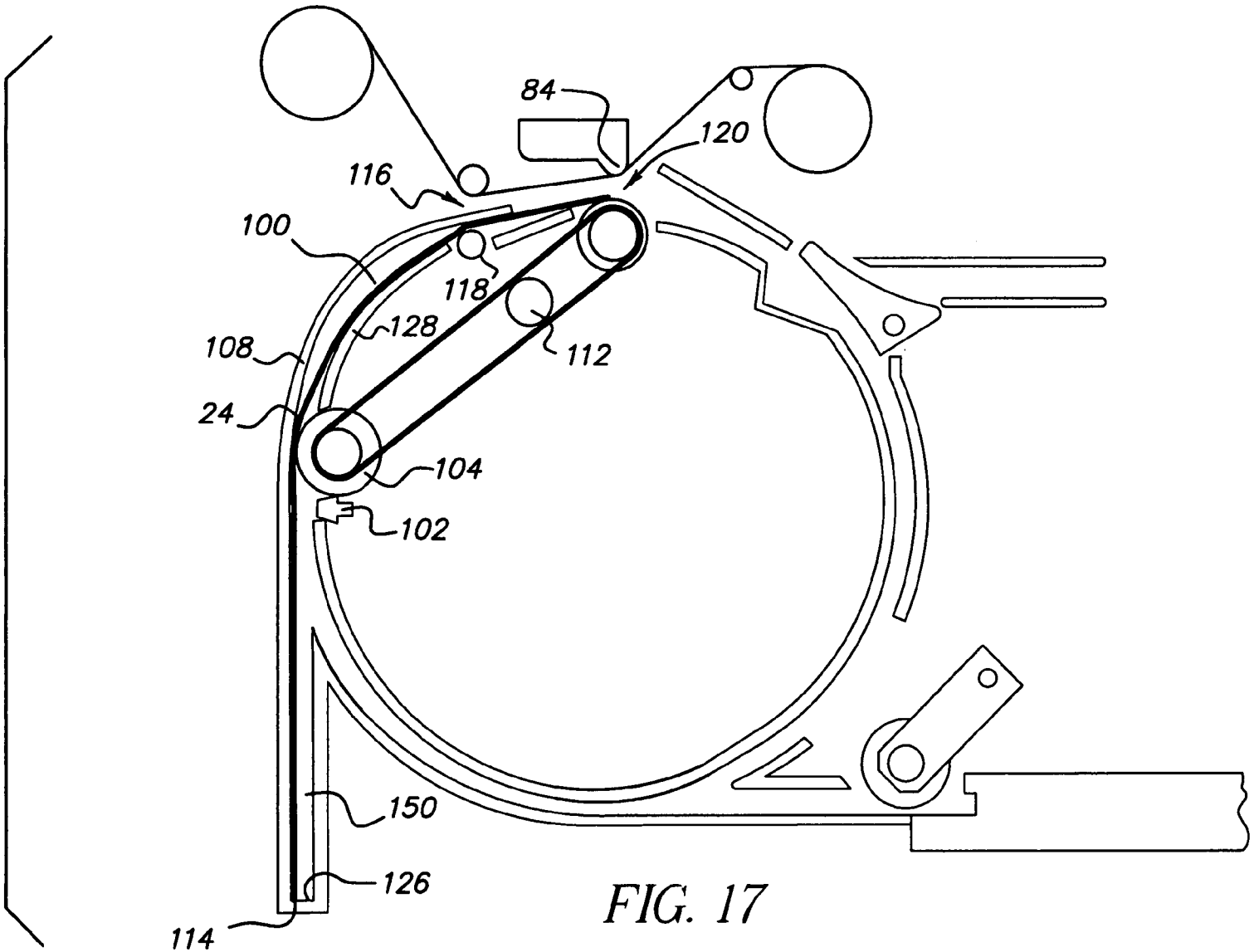

As is shown in FIG. 17, when processor 34 receives a signal from medium sensor 102 indicating that trailing edge 114 of receiver medium 24 has passed medium sensor 102, processor 34 initiates a staging process by transmitting signals causing motor 112 to reverse so that urge roller 104 will drive receiver medium 24 in a reverse direction along a receiver medium path 100. It will be appreciated that when receiver medium 24 is curled or bent in a circular, semi-circular or curved paper path, receiver medium 24 resiliently opposes such motion. This helps to drive trailing edge of receiver medium 114 against outer wall 108 and into medium staging path 150 to a position where trailing edge 114 is positioned against stop surface 126.

When trailing edge 114 is positioned against stop surface 126, receiver medium 24 follows a path of a known distance beginning at stop surface 126 and extending to print line 84. In the embodiment illustrated in FIG. 17, a tension is created in receiver medium 24 between a load applied to receiver medium 24 by outer wall 108 and guide member 118 at space gate 116 and the urging force supplied by urge roller 104 which tends to draw receiver medium 24 against inner wall 128 so as to define a generally known path which receiver medium 24 follows between stop surface 126 and print line 84. However, the application of tension in this manner is optional, and it will be appreciated that receiver medium 24 can be guided by the receiver medium path 100 so that receiver medium 24 follows the known path without the application of such tension.

Figure 18:
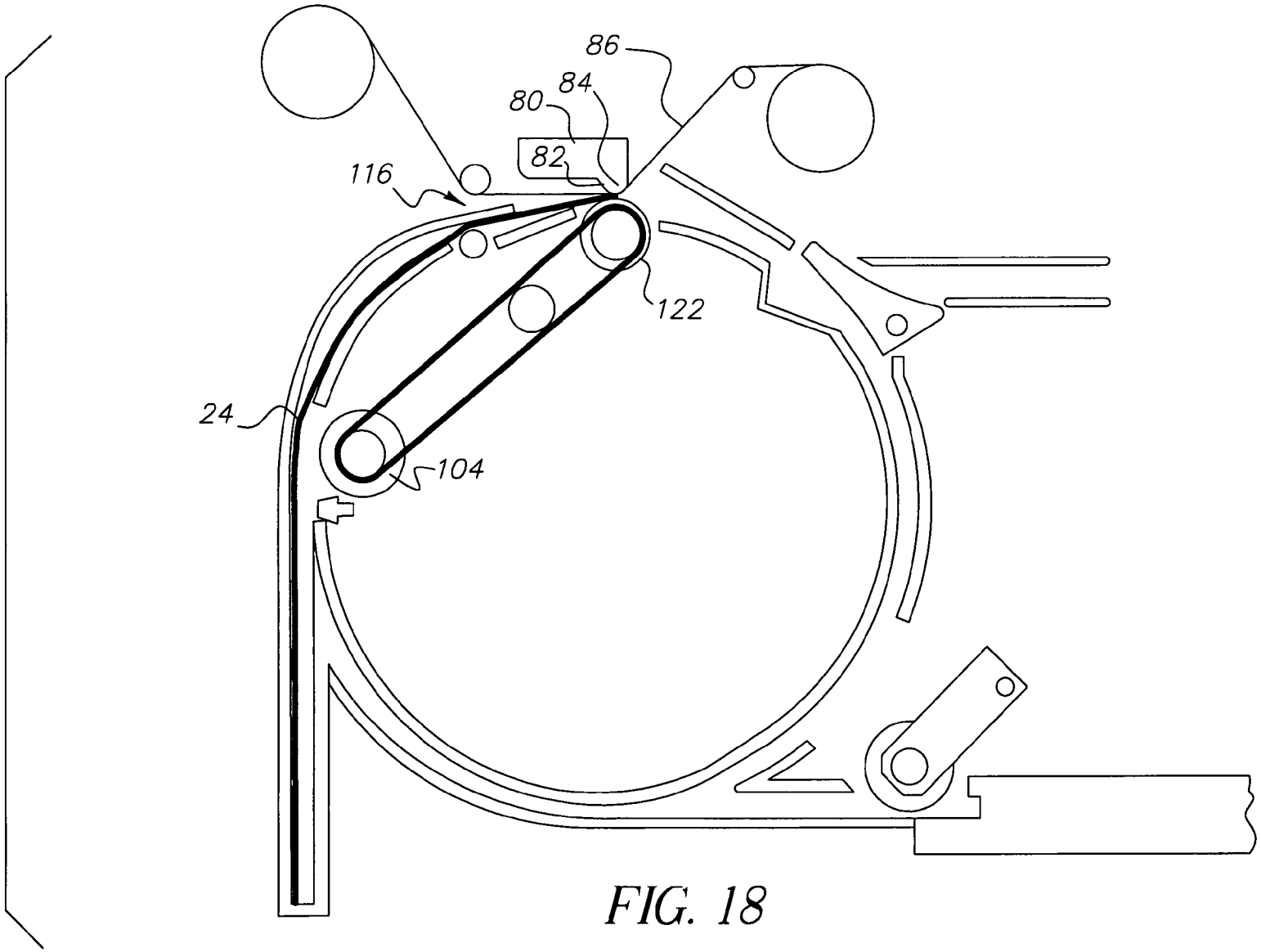

As illustrated in FIG. 18, processor 34 then completes the staging by causing an actuator (not shown) to drive thermal printhead 80 toward platen 122 so that printing elements 82 apply pressure across donor web 86 and receiver medium 24 at print line 84. Processor 34 then optionally causes an actuator (not shown) to move urge roller 104 to a position where urge roller 104 does not contact receiver medium 24 during printing.

Figure 19:
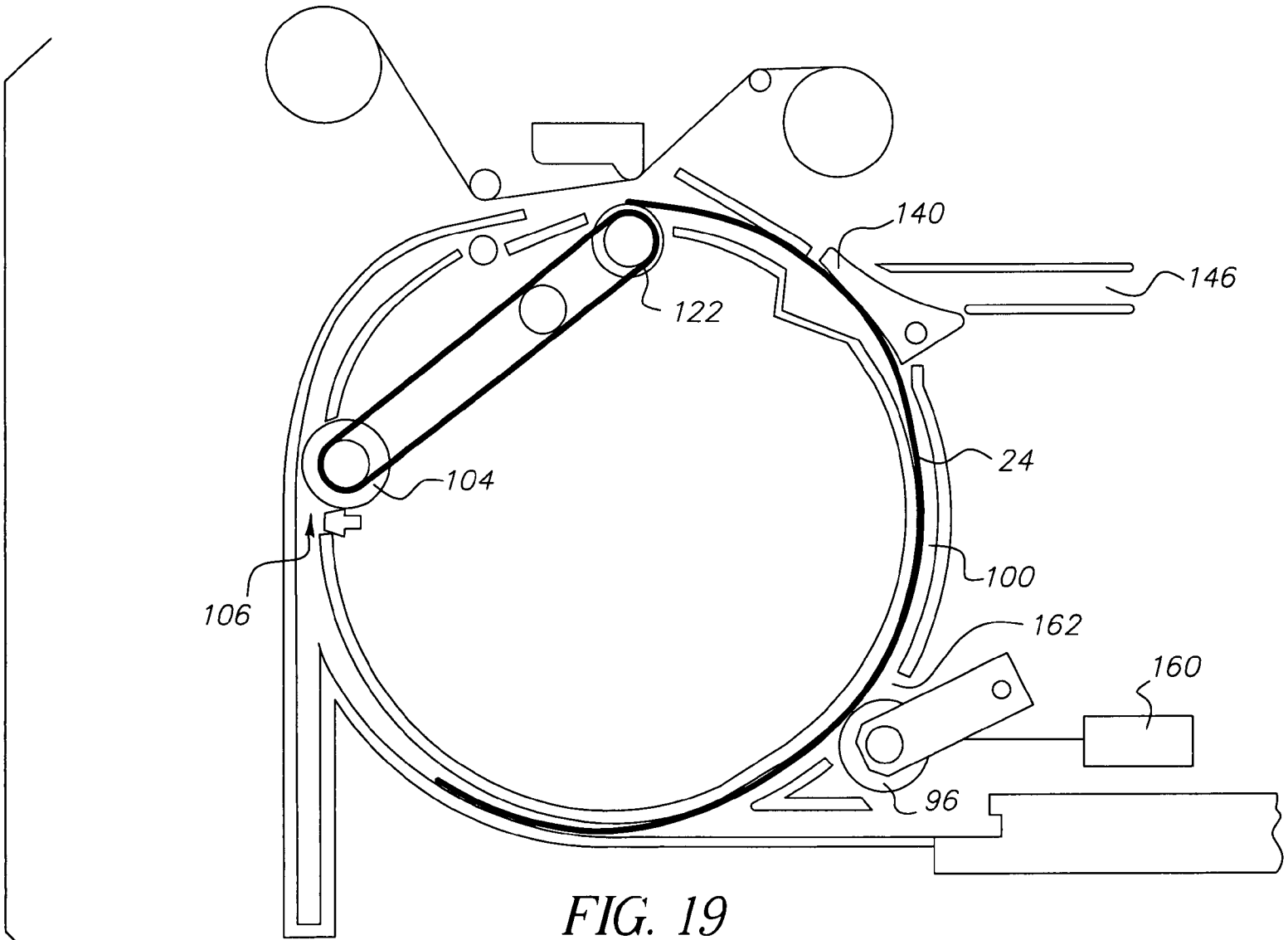

As illustrated in FIG. 19, processor 34 then executes a printing process as is generally described above with respect to FIGS. 7, 8 and 9. However it will be appreciated that in this embodiment platen 122 and urge roller 104 are separated by a distance that can be greater than a length of receiver medium 24. Thus there is a need, in this embodiment, for supplemental urging between platen 122 and urge roller 104 to enable recirculation of receiver medium 24. Accordingly, in this embodiment, actuator 160 is adapted to move pick roller 96 into an opening 162 in medium supply path 100 so as to engage receiver medium 24 and to advance receiver medium 24 until receiver medium 24 enters urge nip 106 wherein urge roller 104 can advance receiver medium 24 for staging as generally described above. During a final printing process, processor 34 can cause diverter 140 to be interposed into medium transport path 100 to deflect receiver medium 24 into an exit path as described above with reference to FIGS. 12, 13 and 14.

It will be appreciated that this embodiment uses generally the same number of components used in the embodiments illustrated in FIGS. 1–14 and provides a similar result. Selection between these embodiments can be made based upon technical, commercial or logistical considerations.

Second Alternate Embodiment of Medium Transport Path

Figure 20:
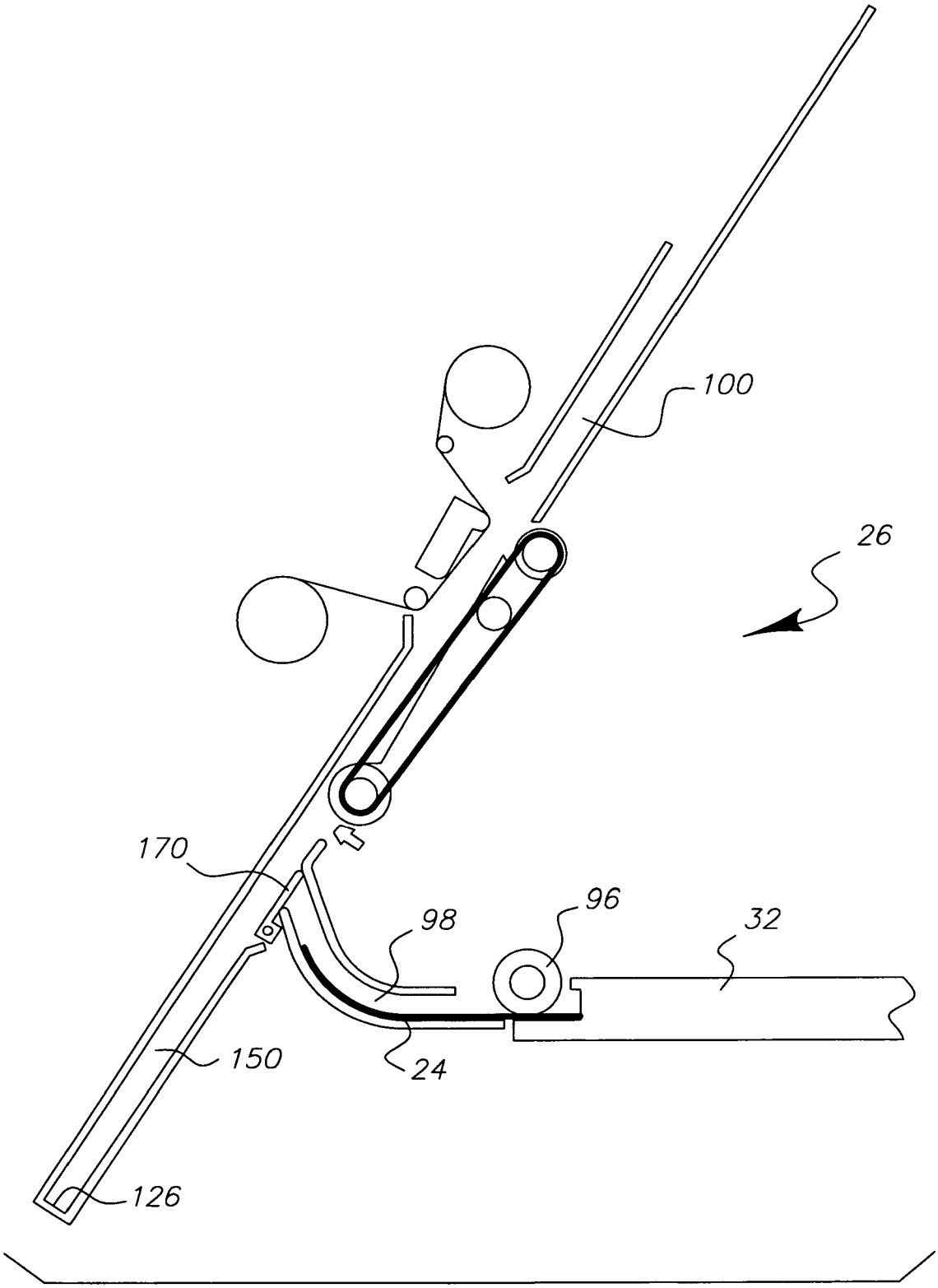
FIGS. 20–25 show another embodiment of a printer of the invention

FIGS. 20–25 illustrate another embodiment of a medium transport 26 of printer 20 of the invention in which a stop surface 126 is provided in a medium staging path 150. In FIG. 20, medium transport 26 is shown during a medium loading process with a sheet of receiver medium 24 being drawn from medium supply 32 by a motor driven pick roller 96. Pick roller 96 urges receiver medium 24 through receiver medium supply entrance slot 98 so that receiver medium 24 passes through a gate 170.

Figure 21:
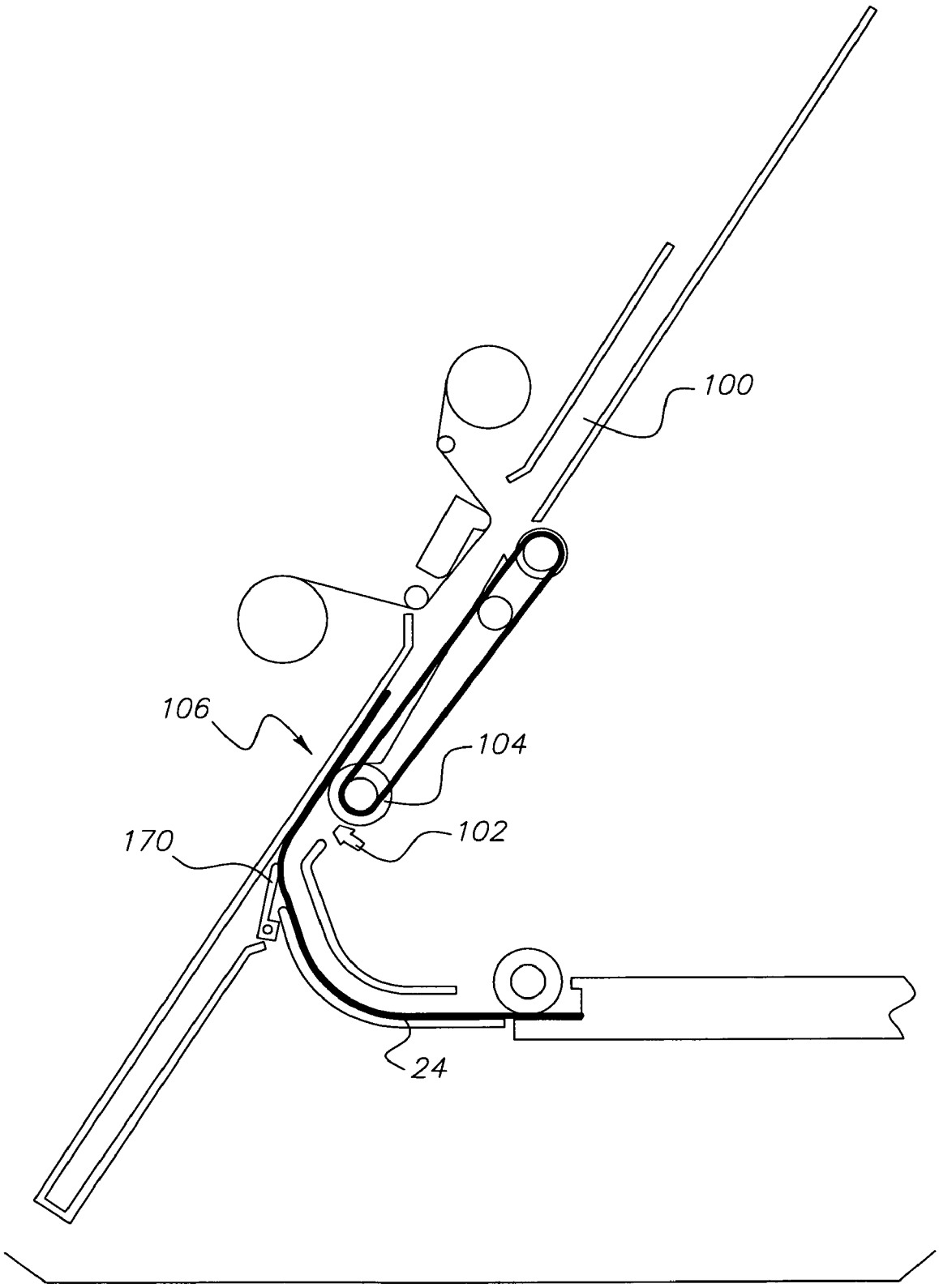

As shown in FIG. 21 further urging of receiver medium 24 then brings receiver medium 24 into medium supply path 100, past receiver medium sensor 102 to urge nip 106. As receiver medium 24 enters urge nip 106, receiver medium 24 is brought into contact with urge roller 104, and urge roller 104 drives receiver medium 24 along receiver medium path 100 to load receiver medium 24.

Figure 22:
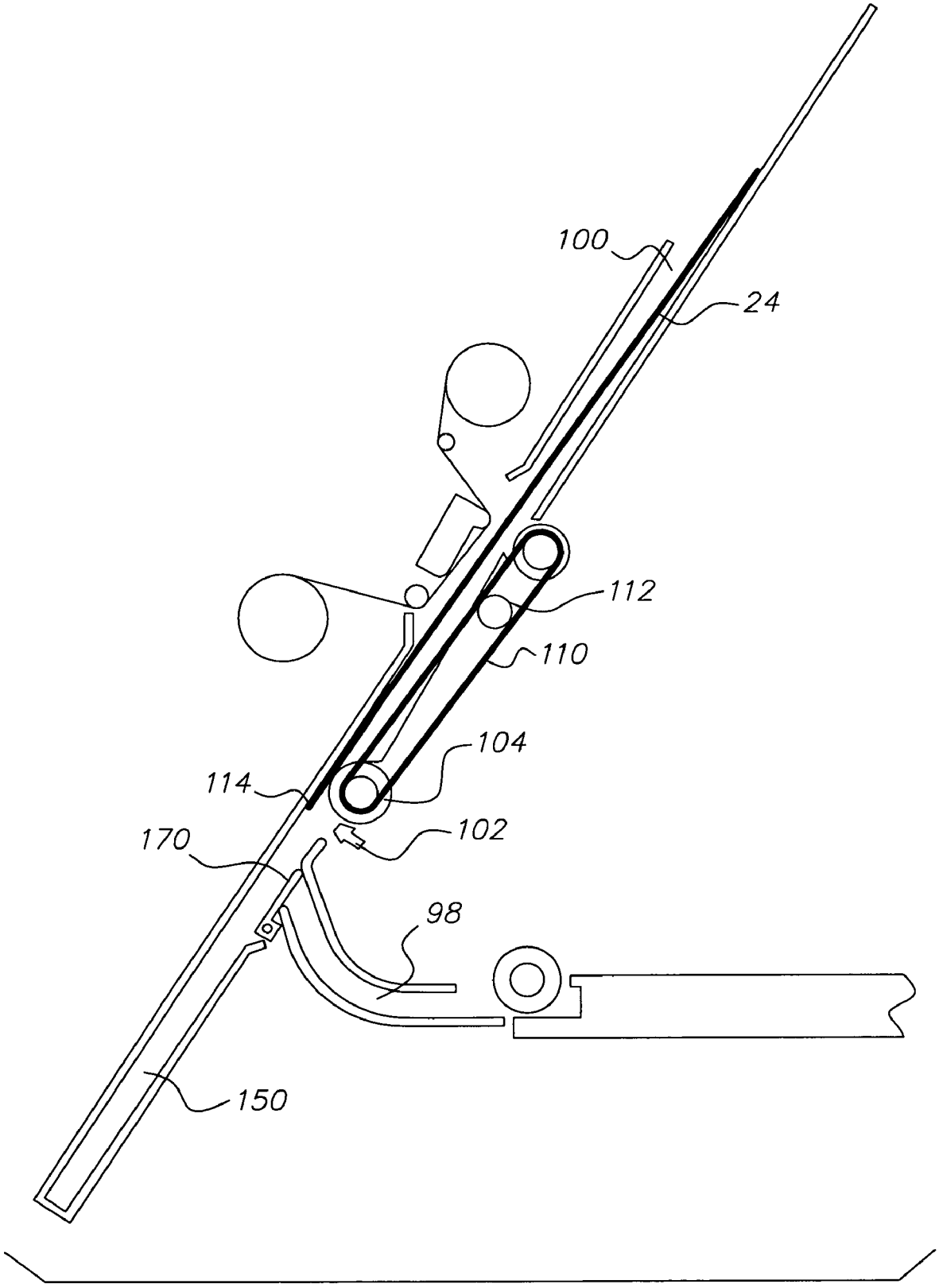

As illustrated in FIG. 22, receiver medium 24 is urged by urge roller 104 in a forward direction against the pull of gravity along receiver medium path 100 to a position where a trailing edge 114 of receiver medium 24 passes medium sensor 102 so that medium sensor 102 no longer detects the presence of receiver medium 24. When this occurs, processor 34 receives a signal from medium sensor 102 indicating that receiver medium 24 is no longer present. Processor 34 then transmits signals causing motor 112 to cease driving belt 110 which, in turn, suspends the rotation of urge roller 104, and any further forward movement of receiver medium 24 along receiver medium path 100.

As is also illustrated in FIG. 22, when receiver medium 24 is advanced along receiver medium path 100, trailing edge 114 of receiver medium 24 passes through gate 170 allowing gate 170 to move to a biased position as illustrated. This blocks receiver medium 24 from entering medium supply entrance slot 98 during subsequent operations, directing receiver medium 24 into medium staging path 150 when moved in a reverse direction. Gate 170 can be biased in a variety of known manners including but not limited to the use of resilient biasing supplied for example by a spring or a leveraged arrangement.

Figure 23:
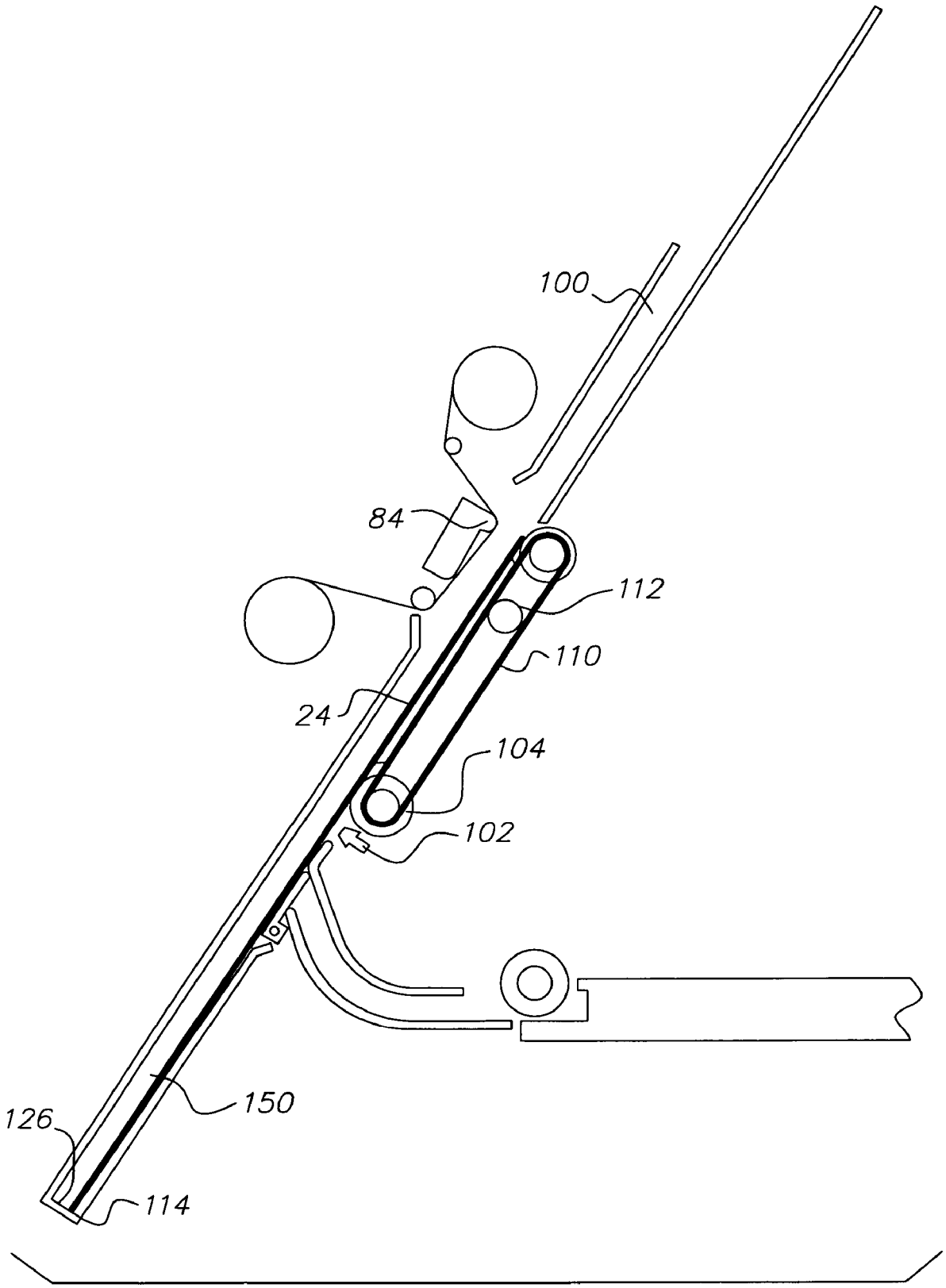

As is shown in FIG. 23, after processor 34 receives the signal from medium sensor 102, processor 34 initiates a staging process by transmitting signals enabling receiver medium 24 to move in the reverse direction into staging path 150. In one embodiment, not shown, processor 34 does this by causing motor 112 to move in a counter-clockwise direction so that urge roller 104 will drive receiver medium 24 the reverse direction along a receiver medium path 100 and into medium staging path 150.

In the embodiment illustrated, processor 34 enables this by transmitting a signal to an actuator (not shown) causing urge roller 104 to retract from a position for urging receiver medium 24 to a position releasing receiver medium 24 that allows gravity to draw receiver medium 24 into staging path 150 to a position against stop surface 126.

When trailing edge 114 is positioned against stop surface 126, receiver medium 24 follows a path of a known length beginning at stop surface 126 and extending to print line 84. In this position, receiver medium 24 can be guided by receiver medium path 100 and medium staging path 150 so that receiver medium 24 follows the path of known length.

Figure 24:
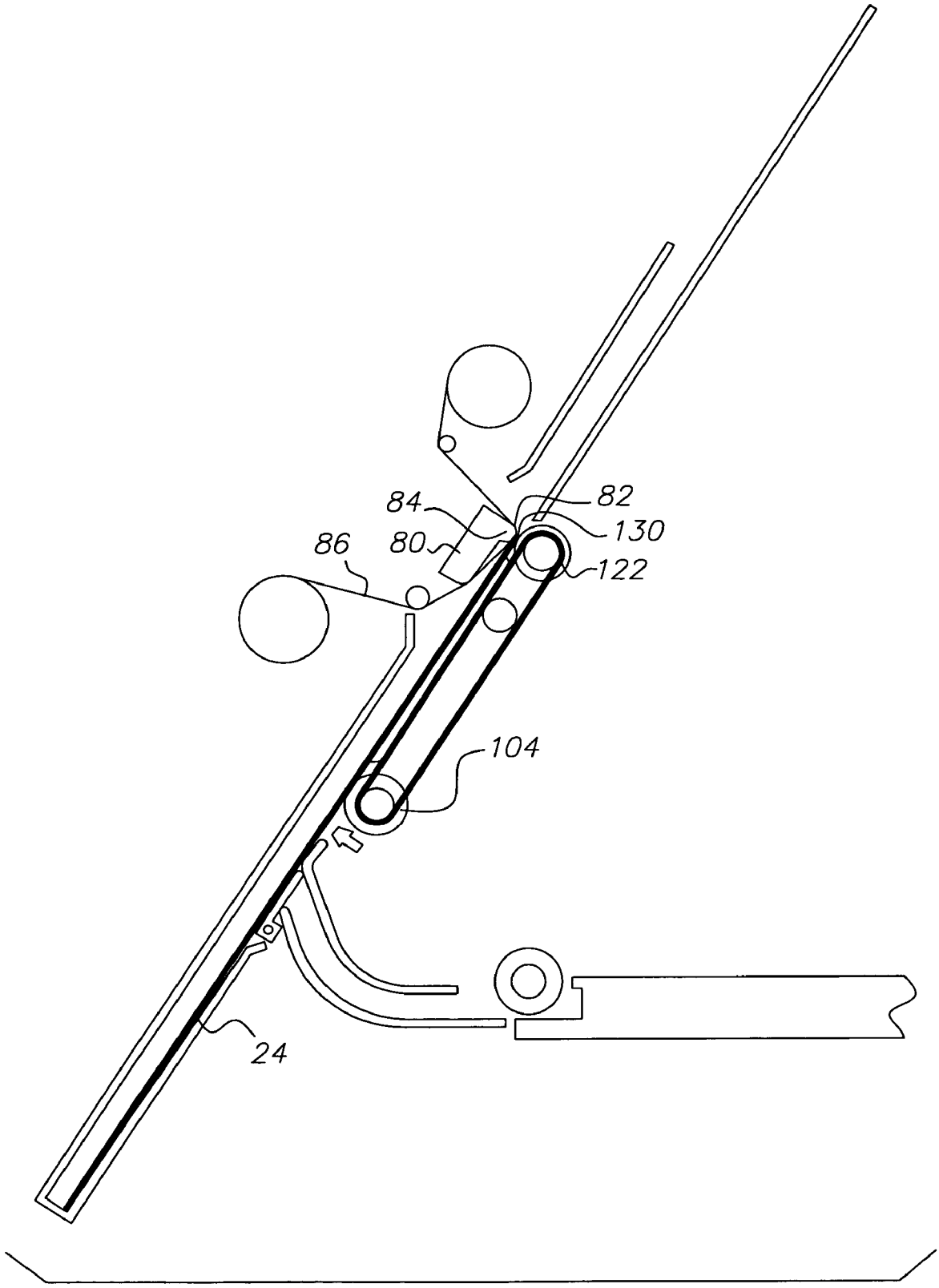

As illustrated in FIG. 24, processor 34 then completes the staging by causing an actuator (not shown) to drive thermal printhead 80 toward platen 122 so that printing elements 82 apply pressure across donor web 86 and receiver medium 24 at print line 84 in preparation for printing.

Figure 25:
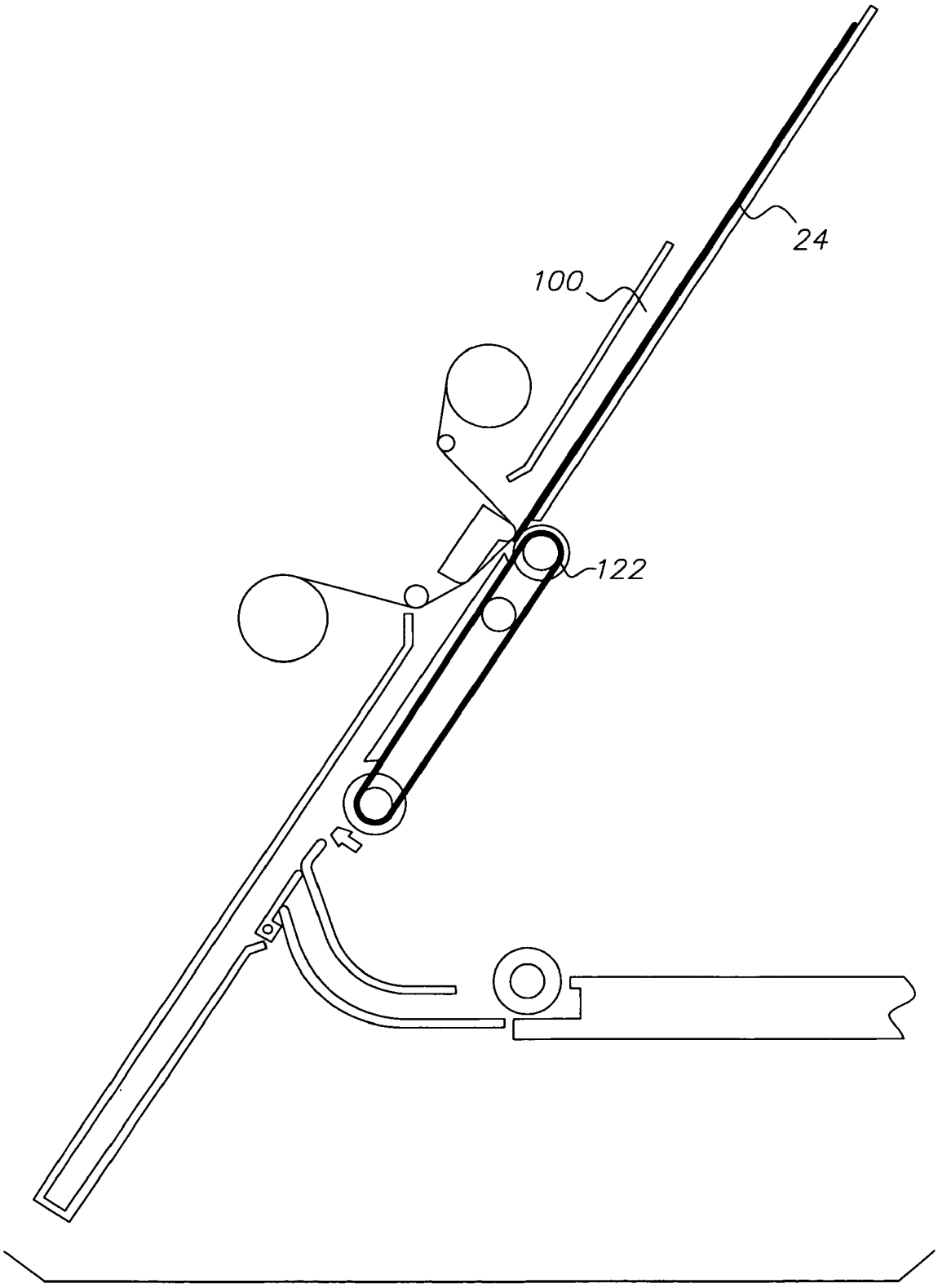

Processor 34 then executes and completes a printing process as is generally described above with respect to FIGS. 7, 8 and 9 leaving receiver medium 24 positioned as shown in FIG. 25 prior to the execution of a return process. In this embodiment, processor 34 the return process can be performed in a variety of ways. In this embodiment, gravity can be used to provide a return force. Accordingly, because in the embodiment of FIGS. 20–25 said receiver medium path 100 is shaped to direct receiver medium 24 so that it is returned to a position where trailing edge 114 is located against stop surface 126 and with leading edge 130 positioned at print line 84 by causing an actuator, not shown, to retract the print head 80 after printing. This allows gravity to move receiver medium 24 in the reverse direction through receiver medium path 100 into medium staging path 150 to the staged position illustrated in FIG. 23. The processes of printing and returning, as described above, can be executed repeatedly as desired to apply multiple layers of donor material on receiver medium 24. During a final printing process, processor 34 can cause a diverter (not shown) to be interposed into receiver medium path 100 to deflect receiver medium 24 into an exit path (not shown) as described above with reference to FIGS. 12, 13 and 14. Alternatively, a fully printed receiver medium 24 can be left in the position shown in FIG. 25 until manually removed.

It will be appreciated that this embodiment uses generally the same number of components used in the embodiments illustrated in FIGS. 1–19 and provides a similar result. Selection between these embodiments can be made based upon technical, commercial or logistical considerations.

In the embodiment of FIGS. 1–14 and in the embodiment of FIGS. 15–19 urge roller 104 and platen 122 are shown as being of different diameters with urge roller 104 being larger sized than platen 122. This provides an advantage in that urge roller 104 can be adapted to move receiver medium 24 at a faster rate during loading, return and staging than platen 122 will move receiver medium 24 during printing assuming a constant rate of rotation of motor 112. However, this is not necessary and in other embodiments urge roller 104 and platen 122 can be sized the same or sized with platen 122 being larger than urge roller 104. Similarly, it will be appreciated that the effect that the relative sizes of urge roller 104 and platen 122 have on the rate of movement of the receiver medium 24 can be mitigated by selective control over the speed of rotation of the urge roller 104 and platen 122 such as by causing motor 112 to operate at different speeds.

In the embodiment of FIGS. 1–14 and in the embodiment of FIGS. 15–19, receiver medium path 100 has been shown as having a generally circular path. This has been done for illustrative purposes and it will be appreciated that any shape of path can be used so long as the capability to move receiver medium as described above can be performed using such a path. Similarly, it will be appreciated that in the embodiment that is illustrated in FIGS. 20–25 a medium transport path 100 has been shown as providing a generally linear path and that this too has been done for illustrative purposes. However, the shape of the path can be non-linear so long as the medium movement capabilities discussed above can be performed using such a path.

In the embodiment of FIGS. 1–14, and in the embodiment of FIGS. 15–19, pick roller 96, urge roller 104 and platen 122 have been shown as rollers. However, it will be appreciated that other structures that are capable of performing the functions of moving receiver medium 24 within the medium transport path can be used to urge, advance, move or position receiver medium 24 within receiver medium path 100, including but not limited to belts, movable plates, gripping structures and the like.

The invention has been described in detail with particular reference to certain preferred embodiments thereof, but it will be understood that variations and modifications can be effected within the spirit and scope of the invention.

PARTS LIST

20 printer
21 housing
22 print engine
24 receiver medium
26 medium transport
32 medium supply
34 processor
36 user input system
38 sensors
40 memory
42 hard drive
44 disk drive
46 memory card slot
48 removable memory
50 removable memory interface
52 remote memory system
54 communication system
56 remote display
58 remote input
66 local display
68 local input
80 thermal printhead
82 printing elements
84 print line
86 donor web
88 donor supply spool
90 first follower roller
92 second follower roller
94 donor take-up spool
96 pick roller
98 medium supply entrance slot
100 receiver medium path
102 medium sensor
104 urge roller
106 urge nip
108 outer wall
110 belt
112 motor
114 trailing edge
116 space gate
118 guide member
120 printing nip
122 platen
126 stop surface
128 inner wall
130 leading edge
134 return path
140 diverter
142 actuator
144 deflection surface
146 exit path
150 medium staging path
160 actuator
162 opening
170 gate

The invention claimed is:

1. A thermal printer comprising:

a receiver medium path shaped to guide a receiver medium for movement in a forward direction from an urge roller to a print line, the print line being between a printhead and a platen with said platen being adapted to controllably position the receiver medium during printing by the printhead and with said receiver medium path further shaped to guide the receiver medium to return to the urge roller after printing;

a stop surface positioned to block reverse movement of the receiver medium;

a motor operable to cause the urge roller to urge movement of the receiver medium through the receiver medium path in the forward direction; and a processor operable to cause the urge roller to move the receiver medium through the receiver medium path in the forward direction until a trailing edge of the receiver medium is moved to a point in the receiver medium path where reverse movement of the receiver medium causes the receiver medium to locate against the stop surface, said processor then enabling the receiver medium to travel in the reverse direction to engage the stop surface wherein the receiver medium path guides the receiver medium along a path of known length from the stop surface to the print line;

said processor further being operable to start printing after the receiver medium is positioned against the stop surface so that the print line is located at a known distance from a trailing edge of the receiver medium when printing is started.

2. The thermal printer of claim 1, wherein said medium supply path guides the receiver medium so that the urge roller moves the receiver medium in a forward direction against gravity and wherein the processor enables the receiver medium to travel in the reverse direction by ceasing the urging of the urge roller.

3. The thermal printer of claim 1, wherein said medium supply path guides the receiver medium along a path that causes the platen to position the receiver medium by moving the receiver medium past the printhead in a direction against gravity and where the receiver medium is returned to a position proximate to the urge roller by allowing gravity to cause the movement in the reverse direction after printing.

4. The thermal printer of claim 3, wherein the medium supply path is further shaped to allow gravity to return the receiver medium to the stop after printing.

5. The thermal printer of claim 3, wherein the motor and the urge roller are operable to return the receiver medium to the stop after the receiver medium has been returned to the urge roller.

6. The thermal printer of claim 1, further comprising a diverter positioned in the receiver medium path between the platen and the urge roller for selectively guiding a receiver medium after printing to one of an exit of the receiver medium path and the urge roller and an actuator for selectively positioning the deflection surface in response to signals from the processor.

7. The thermal printer of claim 1, wherein the length of the path of known length from the stop surface to the print line is generally equal to a length of the receiver material.

8. The thermal printer of claim 1, wherein said urge roller is operable in a reverse direction and wherein said processor is adapted to enable the receiver medium to travel in the reverse direction by urging movement of the urge roller in the reverse direction.

9. The thermal printer of claim 1, wherein the platen and the receiver medium path are arranged so that by positioning the receiver medium during printing, said platen advances the receiver medium to return to the urge roller.

10. The thermal printer of claim 9, wherein the stop surface is positioned between the platen and the urge roller in the forward direction.

11. The thermal printer medium of claim 1, wherein the receiver medium path has a length from the stop surface to the print line that is generally less than the length the receiver material.

12. The thermal printer of claim 1, wherein the stop surface is movable so that the length of the known length can be adjusted.

13. The thermal printer of claim 1, wherein the urge roller and the receiver medium path apply forces to the receiver medium to conform the receiver medium to the path of known length.

14. The thermal printer medium of claim 1, wherein said motor is also linked to said platen to cause the paten to move for controllably positioning the receiver medium.

15. The thermal printer of claim 1, wherein the receiver medium path further comprises a space gate separated from the urge roller to apply a force resisting movement of the receiver medium by the urge roller thereby inducing a tension in the receiver medium that conforms the receiver medium so that it is positioned along the path of known length when positioned against the stop surface.

16. A thermal printer comprising:

a stationary receiver medium path having walls shaped to guide a receiver medium for movement in a forward direction from an urge nip through a print line to stage a receiver medium for use in printing said receiver medium path further shaped to guide the receiver medium as it is moved from the print line to return the urge roller during printing to a point where the receiver medium is positioned to be guided so that it can be staged for a second printing operation;

a stop surface blocking movement of the receiver medium when the receiver medium is moved in a reverse direction through the receiver medium path without interfering with forward movement of the receiver medium through the receiver medium path;

a printing nip at the print line, the printing nip comprising a movable platen to engage the receiver medium and to move the receiver medium past an opposing printhead, the printhead having an array of printing elements arranged across the receiver medium when the receiver medium is positioned at the print line for transferring donor material from a web of donor material to the receiver medium as the platen moves the receiver medium past the print line with the stop surface, receiver medium path, and print line arranged so that the receiver medium path guides the receiver medium along a path of known length from the stop surface to the print line to position the receiver medium with the trailing edge of the receiver medium at generally the same distance from the print line at the start of printing of both the first printing and second printing operation using the receiver medium;

an urge roller at the urge nip to urge the receiver medium for movement at least between the urge nip and the printing nip; and a processor operable in a staging mode to advance the receiver medium through the receiver medium path in the forward direction until a trailing edge of the receiver medium is moved to the position where reverse movement of the receiver medium brings the trailing edge of the receiver medium into contact with the stop surface, with the processor then causing the urge roller to urge the receiver medium in the reverse direction until the stop surface blocks reverse movement of the receiver medium, positioning the receiver medium so that a starting point of the receiver medium is positioned at the print line;

said processor then being operable in a printing mode wherein the processor causes the printing elements to transfer donor material from the web of donor material to the receiver medium while causing the platen to move the receiver medium past the print line, and along the receiver medium path so that the receiver medium is returned to the urge nip;

said processor further being adapted to operate in the staging mode at least one additional time to stage the receiver medium so that a second printing operation can begin with the starting point positioned at the print line.

17. The thermal printer of claim 16, further comprising a diverter positioned between the printing nip and the urge nip for selectively guiding said receiver medium into one of an exit of the receiver medium, and to the urge nip and an actuator for selectively positioning the deflection surface during a final printing process the processor can cause the diverter to direct the receiver medium to an exit path.

18. The thermal printer of claim 16, wherein the receiver medium path further comprises a medium supply entrance slot adapted to engage a medium supply and a rotatable pick roller adapted to engage receiver medium in the medium supply and urge the receiver medium through the medium supply entrance slot to the urge roller to load receiver medium during printing, and wherein said processor is further operable in a loading mode to cause the pick roller to urge receiver medium from the medium supply.

19. The thermal printer of claim 18, wherein the receiver medium path is shaped to guide the receiver medium in the forward direction to return from print line to the urge roller, wherein distance in the forward direction from the printing nip to the urge nip is greater than a length of the receiver medium and wherein said pick roller can be positioned to engage the receiver medium in the receiver medium path to advance the receiver medium to the urge roller when the receiver medium does not contact the platen or the urge roller.

20. A method for operating a printer having a receiver medium path for guiding the receiver medium past a print line of a printhead the method comprising the steps of:

loading the receiver medium into a receiver medium path;

advancing the receiver medium in the forward direction toward a printhead;

reversing movement of the receiver medium until a trailing edge of the receiver medium is blocked against a stop surface at a staged position wherein the receiver medium travels along a path of a known length from the trailing edge of the receiver medium to the print line;

printing a first image beginning at the area at which the print line confronts the receiver medium when the receiver medium is at the staged position;

returning the receiver medium to the staged position; and printing a second image on the receiver medium beginning with the receiver medium in the stage position.

21. The method of claim 20, further comprising the step of diverting the receiver medium to an exit of the printer after the steps of advancing, urging and printing have been performed at least two times.

22. The method of claim 20, wherein said steps of advancing and reversing comprise the steps of advancing the receiver medium to an area in the receiver medium path wherein reverse movement of the receiver medium causes a trailing edge of the receiver medium to be moved against the stop surface and wherein the step of reversing comprises reversing the receiver medium until the trailing edge of the receiver medium contacts the stop surface.

* * * * *